US006019074A

United States Patent [19]

Otome

[11] Patent Number: 6,019,074

[45] Date of Patent: Feb. 1, 2000

[54] PORTING ARRANGEMENT FOR TWO CYCLE ENGINE

[75] Inventor: Kimitake Otome, Iwata, Japan

[73] Assignee: Yamaha Hatsudoki Kabushiki Kaisha, Iwata, Japan

[21] Appl. No.: 09/038,338

[22] Filed: Mar. 11, 1998

[51] Int. Cl.[7] ..... F02B 17/00

[52] U.S. Cl. ..... 123/65 P; 123/65 PD

[58] Field of Search ..... 123/65 P, 65 PD, 123/73 BA, 65 WA, 73 B

[56] References Cited

U.S. PATENT DOCUMENTS

| | | | |
|---|---|---|---|
| 1,520,620 | 12/1924 | Wall | 123/65 P |
| 3,074,388 | 4/1960 | Kruckenberg | 123/65 P |
| 3,425,399 | 2/1969 | Ward et al. | 123/65 WA |
| 4,821,687 | 4/1989 | Iwai | 123/65 P |
| 5,477,838 | 12/1995 | Schlunke et al. | 123/65 P |
| 5,623,895 | 4/1997 | Masuda et al. | 123/54.4 |
| 5,671,703 | 9/1997 | Otome et al. | 123/65 P |

*Primary Examiner*—Willis R. Wolfe
*Assistant Examiner*—Jason Benton
*Attorney, Agent, or Firm*—Knobbe, Martens, Olson & Bear LLP

[57] ABSTRACT

A number of embodiments of two cycle crankcase compression internal combustion engines having at least two cylinders in a common bank in side-by-side relationship. Each embodiment incorporates a main Schnurle type scavenging system that includes a pair of main scavenge passages on opposite sides of the exhaust passage that terminate in main scavenge ports that are disposed in proximity to and on opposite sides of the exhaust port. A transversely extending supplemental scavenge passage is provided for delivering a charge to the combustion chamber to somewhat restrict the scavenging flow so as to prevent fuel from passing out of the exhaust port. Fuel is injected into proximity with this supplemental scavenge passage. This facilitates stratification of the fuel charge. The ports are rotated from normal around the cylinder bore axis in many embodiments to provide a more compact construction. Even in those embodiments where this is not done, the fuel injectors are mounted so that they can be easily accessed from outside of the engine body. Various applications for the engine such as a motorcycle, personal watercraft and outboard motor are depicted.

27 Claims, 25 Drawing Sheets

PORTING ARRANGEMENT FOR TWO CYCLE ENGINE

BACKGROUND OF THE INVENTION

This invention relates to two cycle multi-cylinder engine and more particularly to an improved porting arrangement for such engines.

As is well known, two cycle engines are very popular because their ported nature makes them very simple. In addition, the firing of the cylinder for each revolution increases the specific output of the engine. However, there are a number of problems in connection with the utilization of ported engines.

One of the major problems deals with the fact that the intake cycle takes place at the same time and substantially overlaps the exhaust cycle. In fact, the intake cycle is utilized to purge the exhaust gases from the cylinder through a process that is commonly referred to as "scavenging."

However, when the scavenging is employed in an engine, there is a risk that the fresh air charge may also pass out of the exhaust port with some of the exhaust gases. This problem is particularly troublesome if fuel is also mixed with the exhausted mixture before it has had an opportunity to burn.

One popular type of scavenging system employed with two cycle engines is the Schnurle type. With Schnurle type scavenging, one or more scavenge ports are placed in proximity to the exhaust port. The flow of air into the combustion chamber from the scavenge ports is directed toward the opposing side of the cylinder wall for redirection upwardly and across the cylinder head. The charge then flows back downwardly to the exhaust port. This type of scavenging also uses, at times, an auxiliary scavenging port which is directly opposed to the exhaust port. Although this type of scavenging is very effective, there nevertheless is some concern that the fresh charge may pass out of the exhaust port.

A scavenging type of system has been proposed that employs a supplemental scavenge or tumble port that is disposed transversely to the main scavenge ports. This port introduces a tumble flow into the cylinder on the side facing away from the exhaust port. This permits the attainment of stratification and also improves or reduces the likelihood that fuel will pass out of the exhaust port. A construction of this type is shown in U.S. Pat. No. 5,671,703, issued Sep. 30, 1997 and assigned to the assignee hereof.

Although the system shown in that patent is very effective, there still seem to be ways to further improve performance. For example, it has been found that the utilization of tumble, although helpful is not always desirable. There is, however, desire to at least redirect the scavenge flow from the main scavenge ports so that the charge is directed somewhat away from the side opposite to the exhaust port.

It is, therefore, a principal object of this invention to provide an improved scavenging system for a two cycle engine.

It is a still further object of this invention to provide an improved scavenging system for an engine that achieves good scavenging and also which will permit stratification and ensure against fuel from passing out of the exhaust port.

Where an engine is provided with a porting arrangement that includes scavenging ports on the side of the exhaust port and also a supplemental, scavenging port that forms a primary function of redirecting the flow from the main scavenge ports, additional problems arise. That is, that the ports are generally positioned in such an area that if a multiple cylinder engine is provided, the main scavenging passages for adjacent cylinders must be directly adjacent each other in the plane containing the cylinder bore axes. Thus the cylinder bores must be spaced axially from each other so that there is clearance between these passages. This results in a longer than desired engine.

It is, therefore, a still further object of this invention to provide an improved scavenging system that uses main scavenging ports and a supplemental port for assisting in stratification and wherein the ports are configured so that an inline engine can be compact in length.

It has also been found that a scavenging system as described can be very useful in achieving stratification if fuel is injected into the stream of air circulated from the supplemental scavenging port. In fact, in some instances it may be desirable to inject the fuel into the scavenging passage serving this port. Since the exhaust port is positioned on an outer side of the cylinder block, this makes the positioning of the fuel injector difficult.

It is, therefore, yet another object of this invention to provide an improved scavenging system for an engine of the described type wherein a fuel injector can be easily placed for servicing and still spray into the supplemental scavenging flow for stratification purposes.

SUMMARY OF THE INVENTION

The features of this invention are adapted to be embodied in a two cycle internal combustion engine having a cylinder block that defines at least two cylinder bores having parallel side-by-side axes. A cylinder head closes one end of the cylinder bores. A piston reciprocates in each of the cylinder bores to form with the cylinder bores and the cylinder head respective combustion chambers. An exhaust port is formed in one side of the cylinder bores at the inlet end of a respective exhaust passage that is formed in the cylinder block and which is opened and closed by the reciprocation of the respective piston. A pair of circumferentially spaced main scavenge ports are formed in each of the cylinder bores on opposite sides of the exhaust port and are served by respective main scavenging passages configured so as to create a scavenging airflow that moves axially along the respective cylinder bore toward the cylinder head, across the respective cylinder bore and down the cylinder bore toward the respective exhaust port. Each of the cylinder bores also has an supplemental scavenge port for introducing an airflow into the respective cylinder bore.

In accordance with a first feature of the invention, the supplemental scavenge port is configured and directed so as to redirect the flow of the charge from the main scavenge ports away from the side of the cylinder bore that is diametrically opposite to the exhaust port.

In accordance with another feature of the invention, the ports are arranged circumferentially around the respective cylinder bores so that the main scavenge passage of the cylinder bore is nested between the scavenge passage and exhaust passage of an adjacent cylinder bore.

In accordance with a further feature of the invention, a fuel injector is mounted in a position to spray into the path of the air issuing from the supplemental scavenge port. The fuel injector is positioned on an exterior surface of the engine.

DETAILED DESCRIPTION OF THE PREFERRED EMBODIMENTS

Figure 1:
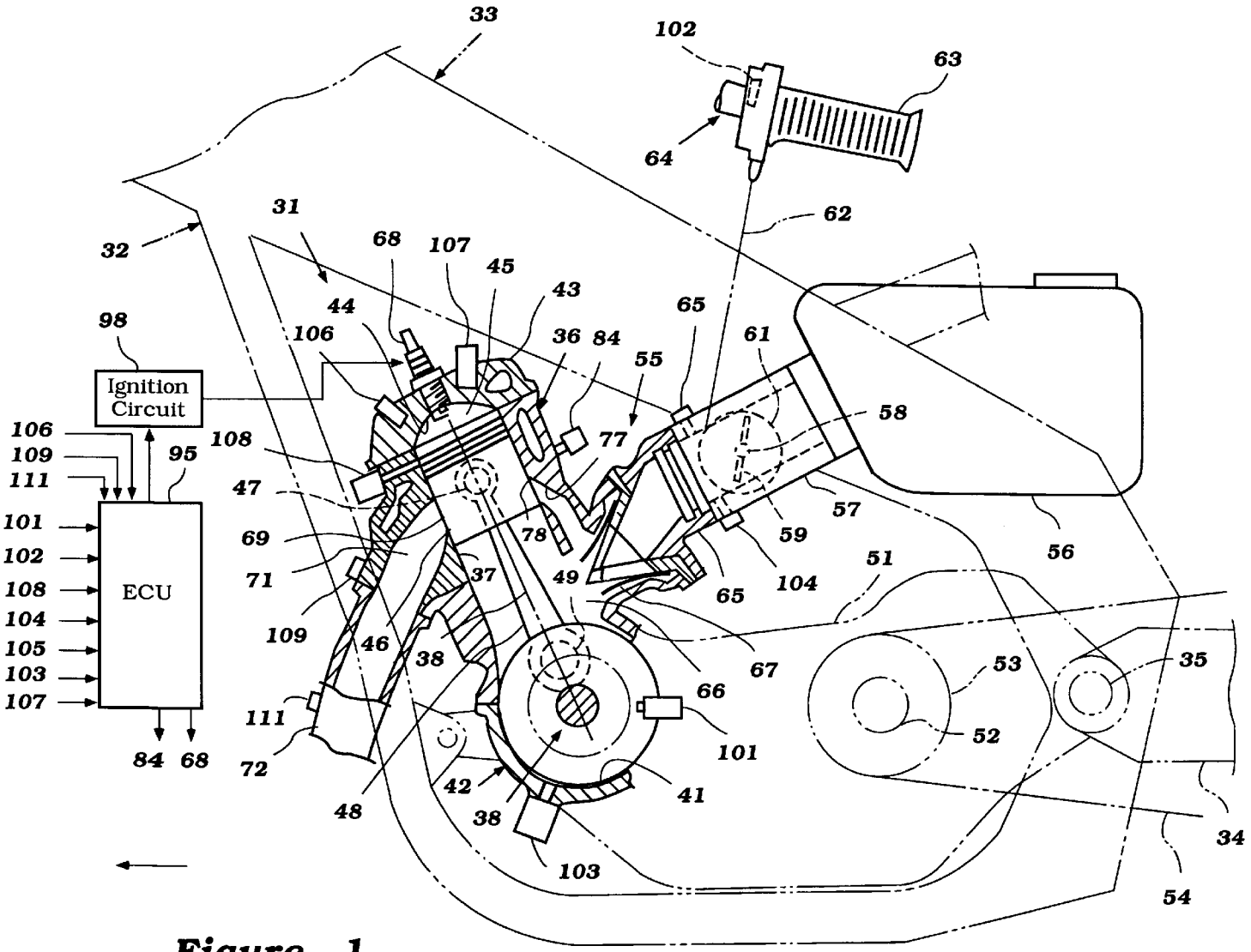
FIG. 1 is a side elevational view of a portion of a motorcycle powered by an internal combustion engine constructed in accordance with an embodiment of the invention. The engine and its control elements are shown in solid lines and in part schematically while the associated motorcycle except for the control portion is shown in phantom lines. In addition, a portion of the engine is broken away so as to more clearly show the engine construction.

As should be readily apparent from the foregoing description, the invention relates primarily to two cycle internal combustion engines. Shown in the specific embodiments which will be hereinafter described are several types of applications where two cycle engines are employed. These applications are applications where high specific outputs and small compact size is required, as is typical with two cycle engine applications. Of course, the specific applications described should be considered only exemplary of those with which the invention may be utilized. Those skilled in the art will readily understand how the invention can be applied to a wide variety of types of two cycle engines and applications of such engines.

The first embodiment, which is shown in FIGS. 1–8 shows the application of the invention to an internal combustion engine, indicated generally by the reference numeral 31 which is employed for powering a motorcycle, which is shown partially in phantom and which is identified generally by the reference numeral 32. The motorcycle 32 is comprised of a frame assembly, indicated generally at 33 from which a rear wheel journaling, trailing arm 34 is supported for pivotal movement by a pivot pin 35 carried by the frame assembly 33.

The engine 31 is depicted as being of a three-cylinder inline type. It will be readily apparent to those skilled in the art how the invention can be applied to other numbers of cylinders and other cylinder configurations. However, certain facets of the invention do have particular utility in engines having aligned cylinder bores with at least two parallel cylinders in the same cylinder bank. Some other engine configurations will also be described in the remaining embodiments.

The engine 31 is comprised of a cylinder block 36 which, in this embodiment, has three aligned cylinder bores 37. These cylinder bores 37 have respective cylinder bore axes 38 which all lie in a common plane. In the specific motorcycle type application, the plane defined by the cylinder bore axes 38 is inclined forwardly and upwardly from a crankshaft 39.

The crankshaft 39 is journaled in a crankcase chamber, indicated generally by the reference numeral 41 and which is formed by the skirt of the cylinder block 36 and a crankcase member 42 that is detachably affixed thereto. The manner of journaling the crankshaft 39 may be of any known type. However, and as is typical with two cycle engine practice that embodies crankcase compression, the crankcase chambers 41 associated with each of the cylinder bores 37 are sealed from each other in any appropriate manner.

A cylinder head assembly 43 is affixed in a suitable manner to the cylinder block 36. The cylinder head assembly 43 is formed with recess surfaces 44 each of which defines a cavity 45. These surfaces 44 close the upper end of the cylinder bores 37 and cooperates with pistons 46 that are slidably supported in the respective cylinder bore 37 for forming the individual combustion chamber of the three cylinders. At times these combustion chambers will be referred to by the reference numeral 45. This is because this cavity forms the major portion of the combustion chamber at top dead center position of the pistons 46.

Each piston 46 is connected by means of a piston pin 47 to the upper or small end of a connecting rod 48. The lower or big end of the connecting rod 48 is journaled on a throw 49 of the crankshaft 39 for transmitting rotary force thereto, as is well known in this art.

The crankcase chamber 41 is formed as a part of a crankcase transmission assembly, indicated primarily in phantom and by the reference numeral 51. As is typical with motorcycle practice, this crankcase transmission assembly 51 contains a change speed transmission and clutch assembly. This is utilized to drive an output shaft 52 which extends outwardly from one side of the assembly 51. A sprocket 53 is affixed to this extending shaft end and drives a chain or other flexible transmitter 54 for driving the rear wheel suspended at the trailing end of the trailing arm 34 in a known manner.

An induction system, indicated generally by the reference numeral 55, supplies at least an air charge to the crankcase chambers 41. This induction system 55 is comprised of an air inlet device 56 which draws atmospheric air from the surrounding area. A suitable inlet is provided for this purpose. The air inlet device 56 may include an arrangement for silencing the inducted air and also for filtering it.

The air thus inducted is delivered to a manifold arrangement in which throttle bodies 57 are provided. Each throttle body 57 includes a throttle valve shaft 58 on which a throttle valve 59 is affixed for controlling the airflow to the engine and, accordingly, it speed and output.

A throttle actuating pulley 61 is affixed to an exposed end of the throttle shafts 58 and is operated by a throttle wire assembly 62. This throttle wire assembly 62 is operated by a handle grip throttle control 63 mounted on a handlebar assembly, shown partially and indicated at 64 as is well known in this art.

The air charge which has been inducted and which passes the throttle valve 59 is delivered to a manifold body 65. This manifold body 65 is mounted on the cylinder block 36 so as to communicate with a respective intake ports 66 so as to permit the inducted air charge to flow into the crankcase chambers 41 associated with each of the cylinder bores 37. This charge is inducted when the pistons 46 are moving upwardly to decrease the volume of the combustion chamber 45 and increase the volume of the crankcase chambers. As the pistons 46 move downwardly, this charge is compressed.

Reverse flow through the induction system 55 is precluded by reed-type valve assemblies 67 mounted in the intake port 66 and permitting flow only into the crankcase chambers 41. Such arrangements are well known in the art.

The air charge which has been delivered into the crankcase chambers 41 by the induction system 55 and compressed therein is then transferred to the combustion chambers 45 through a scavenging system, which will be described later by reference primarily to FIGS. 3 and 5, 6 and 8. Fuel is mixed with the air, in a manner which is also to be described, and is then further compressed in the combustion chambers 45. This charge is fired by spark plug 68 mounted in the cylinder head assembly 43. The ignited charge burns and expands to drive the pistons 46 downwardly to continue the cycle of operation.

The burnt charge is exhausted through an exhaust system which includes exhaust ports 69 formed in the cylinder block 36 and each of which communicates with a respective cylinder bore 37. The exhaust ports 69 serve exhaust passages 71 which are also formed in the cylinder block 36.

This burnt charged is then discharged through an exhaust manifold assembly 72 and exhaust system, the bulk of which is not illustrated, for discharge to the atmosphere in a known manner. The relationship of the exhaust port 69 to the scavenging port and the relation of the various scavenging and exhaust passages in the cylinder block 36 for the respective cylinders will also now be described by reference primarily to the remaining figures of this embodiment except for FIG. 4.

Figure 8:
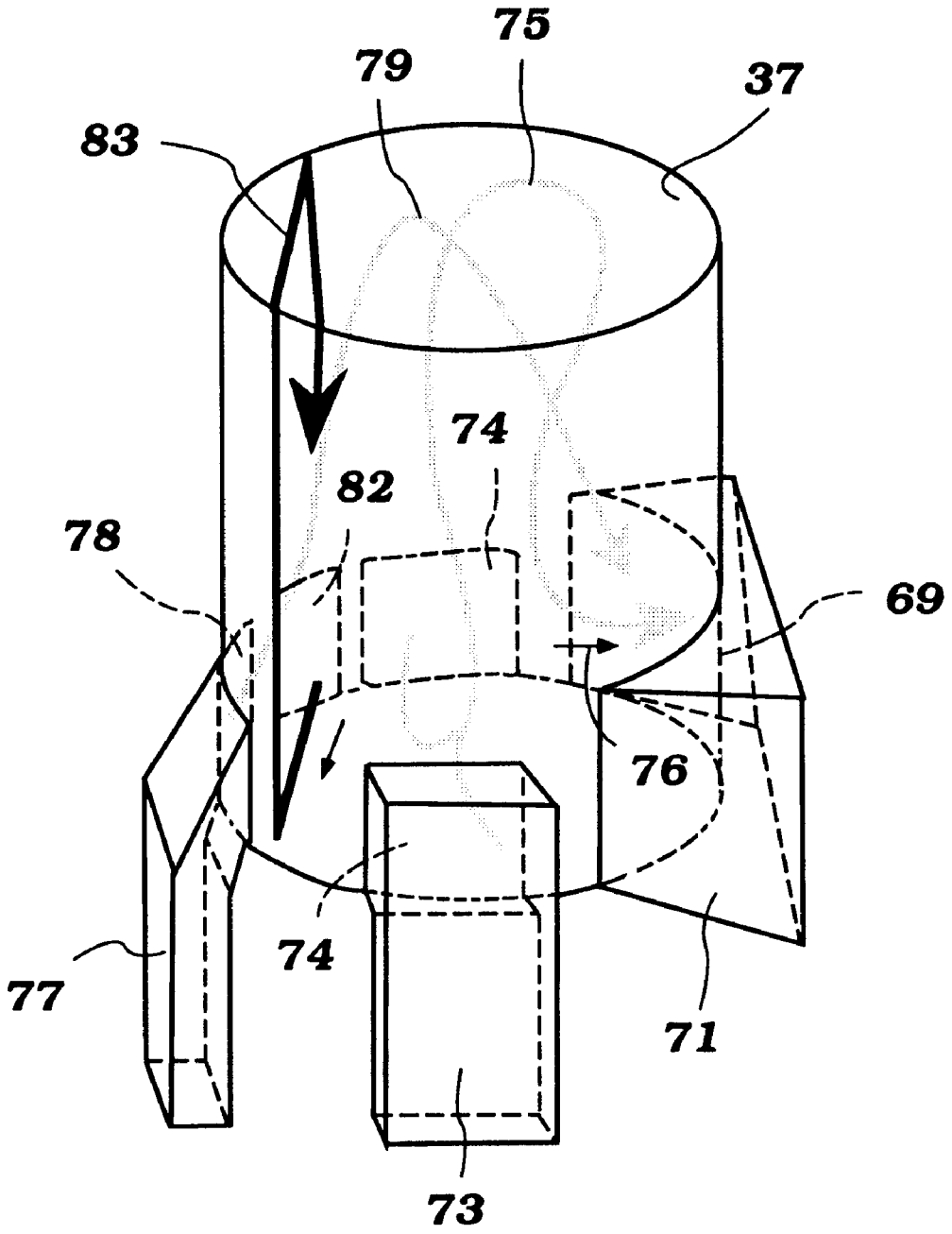
FIG. 8 is a view, in part similar to FIG. 5 but shows in perspective the air flow paths and the supplemental scavenging path during the engine operation.

The scavenging system includes, for each cylinder bore 37, a pair of main Schnurle type scavenging passages 73 which extend from inlet openings in the crankcase chamber 41 on opposite sides of the cylinder block exhaust passages 71 upwardly to terminate at main scavenge ports 74 formed in the cylinder bore 37. These main scavenge passages 73 and their associated main scavenge ports 74 are configured so that the intake charge delivered by them will flow generally upwardly along the respective sides of the cylinder bore 37 toward the cylinder head 43. At this point, the charge will be deflected downwardly toward the exhaust port 69. This flow path is shown in FIG. 8 and is indicated by the reference numeral 75. This will result in the discharge of the gases toward the exhaust port 69 in the direction shown by the arrow 76 in FIG. 8.

In addition, there is provided an auxiliary scavenge passage 77 which extends from the crankcase chamber 41 adjacent the intake port 66 upwardly to terminate in an auxiliary scavenge port 78. The flow from this auxiliary scavenge passage 77 and scavenge port 78 will also tend to flow upwardly along the cylinder bore 73 to reach the cylinder head 43 and redirect it downwardly so as to pass in the direction 76 out of the exhaust port 69. This flow path is shown by the shaded line 79 in FIG. 8.

The scavenging effect thus, provided by these main and auxiliary scavenge passages 73 and 77 and their respective scavenge ports 74 and 78 tends to cause very good scavenging. However, this increases the likelihood that fuel which is mixed with the air, in the manner to be described shortly, may also flow out of the exhaust port 69 because of the good scavenging.

Therefore, a flow redirecting, supplemental scavenge passage 81 is provided for each cylinder bore 37. These passages are shown best in FIG. 5 but also appear in FIGS. 3, 6 and 8. These supplemental scavenge passages 81 terminate in supplemental scavenge ports 82 that are disposed so as to extend transversely across the cylinder bore 37 and in a path to traverse the cylinder bore, strike the cylinder bore wall on the opposite side, be directed upwardly toward the cylinder head and then transversely across the cylinder head and downwardly to the opposite side of the cylinder bore surface 73. This flow path is shown by the solid line 83 in FIG. 8. The angle of this flow path relative to the line L is about or greater than 90° when measured in a direction from the exhaust port center C.

The effect of this flow will cause some redirection of the flow from the main scavenge passages 73 and specifically the most adjacent one. This will tend to slightly restrict the scavenging flow and will provide an area of stratification on the side of the cylinder bore 37 diametrically opposed to the exhaust ports 69.

The motion caused by the supplemental flow redirecting scavenge passage 81 and its port 82 will generate somewhat of a tumble motion in the cylinder bore as shown. Although the tumble motion is particularly desirable, good effects may also be obtained merely by redirecting the flow of the main scavenge passages and ports without totally effecting a tumble action.

Fuel injectors 84 are mounted in the cylinder block 36 and in a preferred embodiment are disposed so that their spray axes are substantially aligned with a portion 85 of the supplemental passages 81 that leads directly to the ports 82. Because of this, the injected fuel will be mixed with the air flowing through the path 83 and this will provide a stratified charge of fuel in the area that is isolated from the exhaust port 69. This will ensure not only against the emission of unwanted fuel into the exhaust system but also will assure the presence of a rich stoichiometric mixture at the gap of the spark plug 68 at the time of firing.

Figure 5:
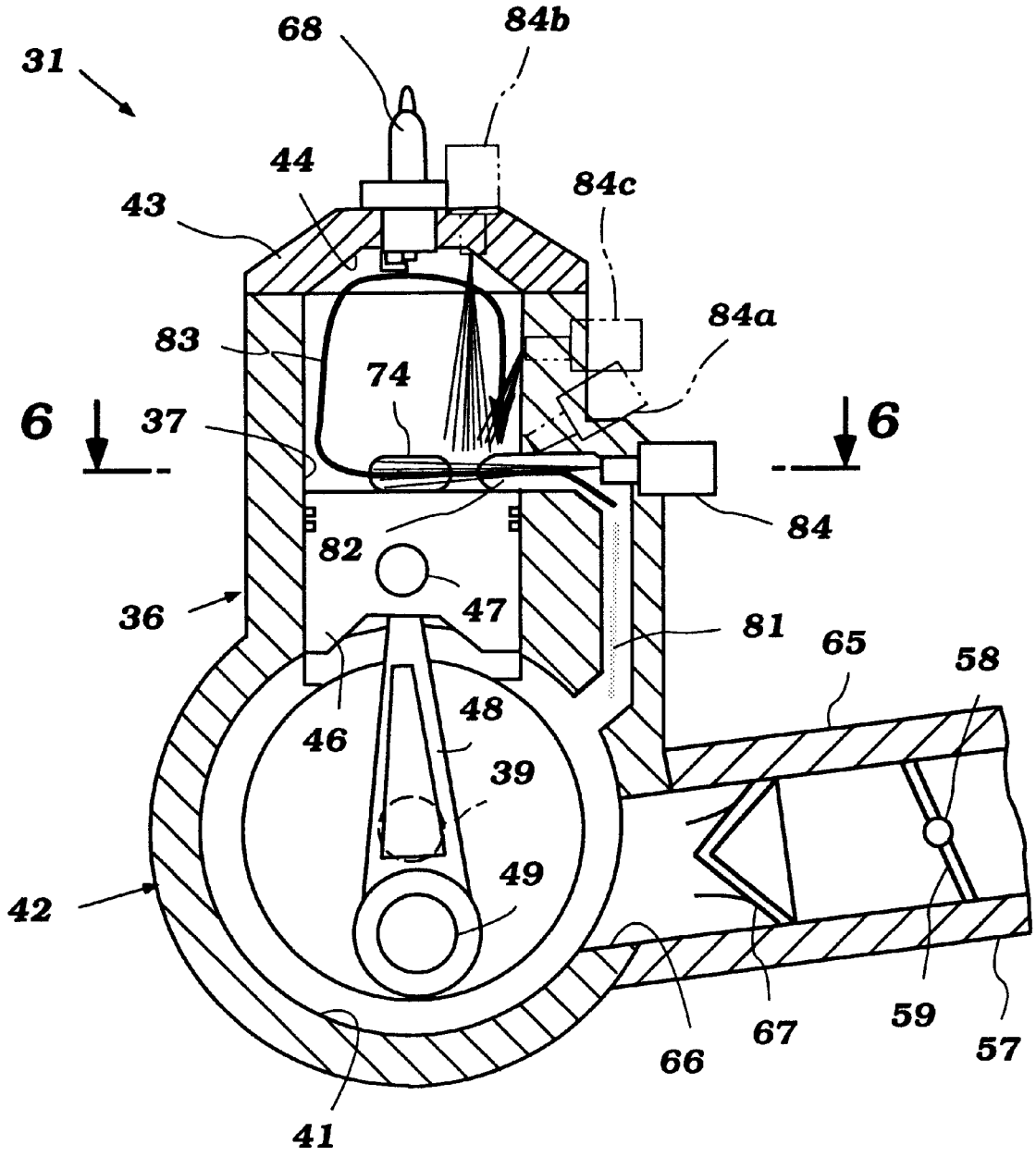
FIG. 5 is a cross-sectional view, in part similar to the view of FIG. 1, and shows the air flow and fuel injection path created by the auxiliary scavenge passage and illustrates alternative fuel injector locations in phantom lines.
Figure 6:
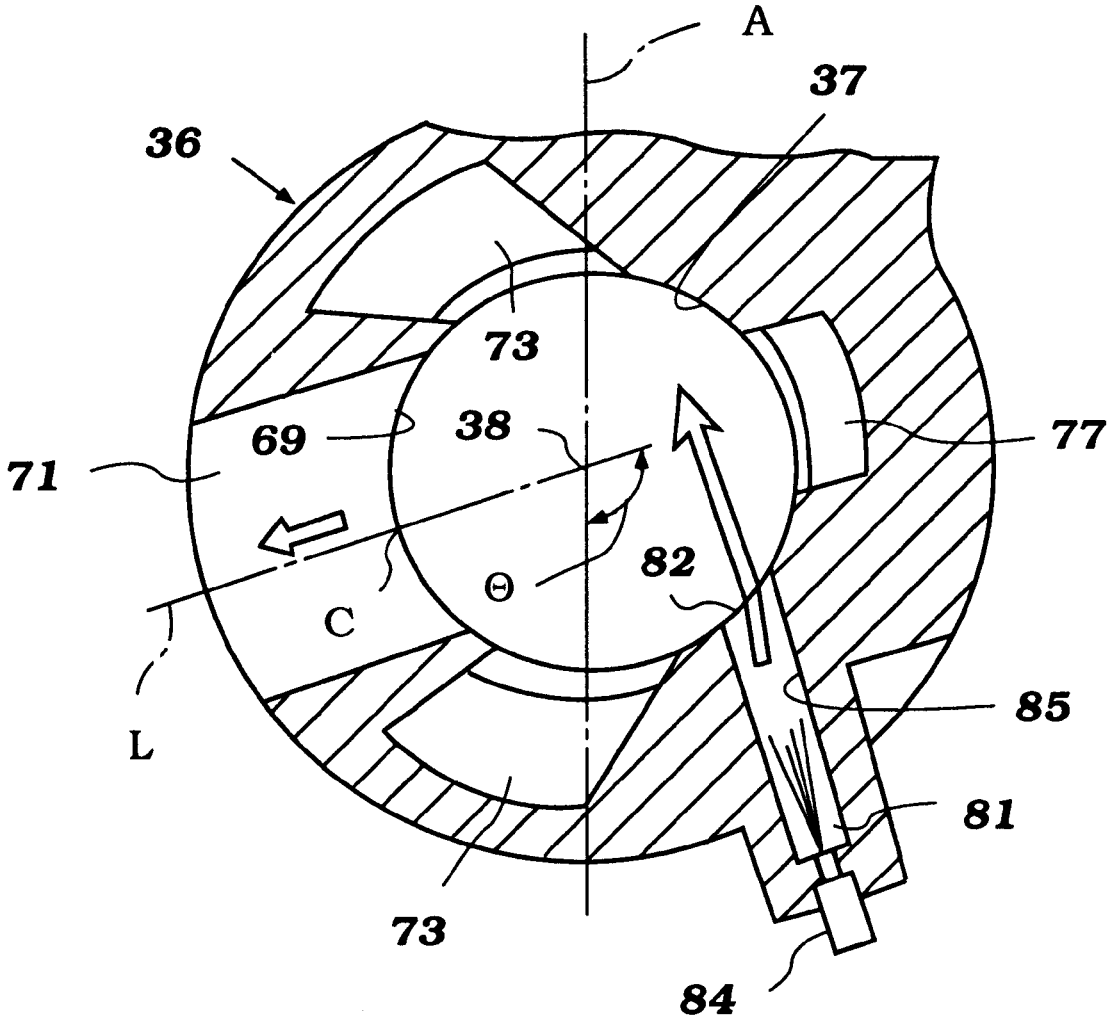
FIG. 6 is a cross-sectional view taken along the line 6—6 of FIG. 5.
Figure 7:
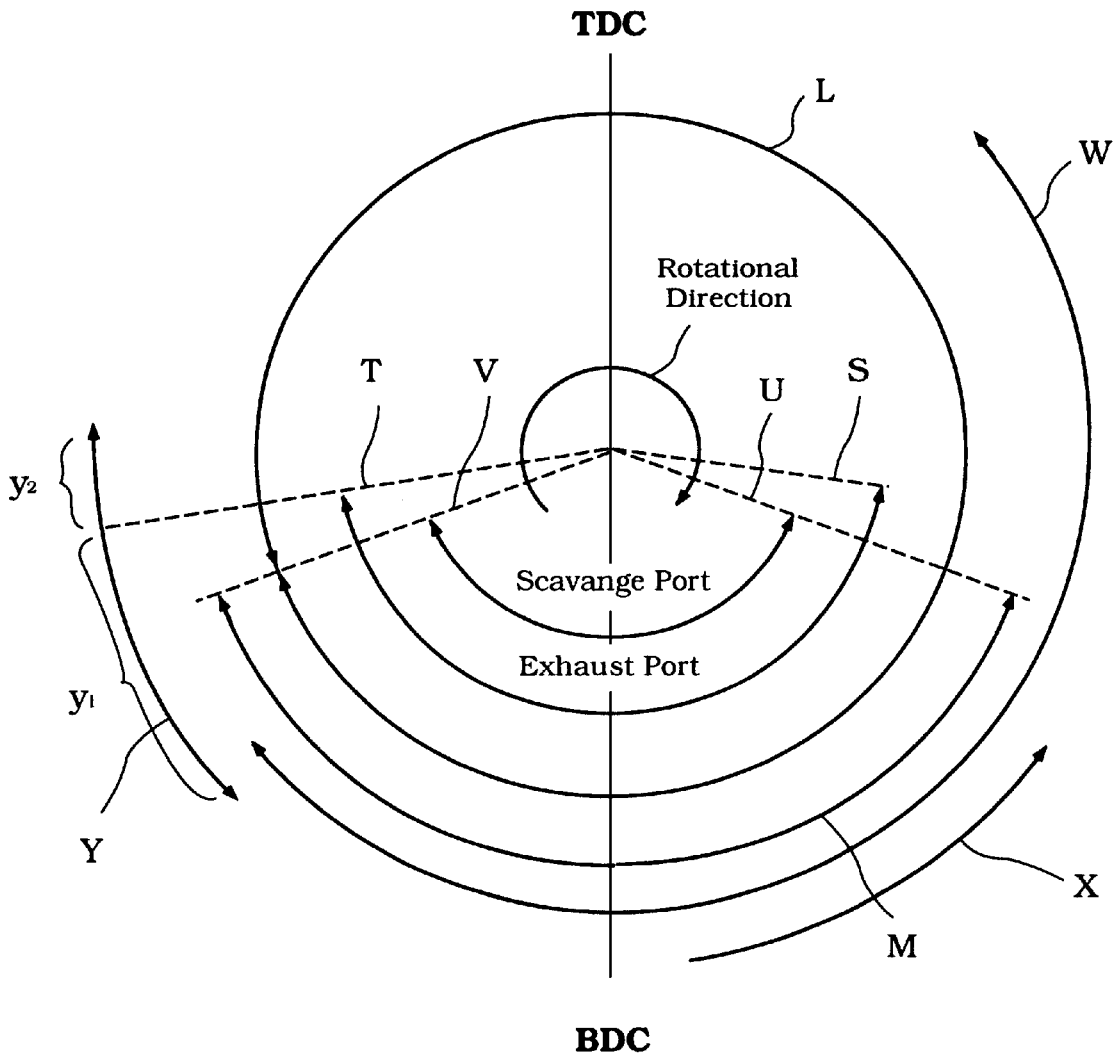
FIG. 7 is a timing diagram showing the opening and closing of the various ports during a complete cycle of rotation of the engine crankshaft and to facilitate the understanding of the fuel injection timing.

Although the arrangement wherein the injectors 84 spray coaxially with the passage portions 85, other locations are possible so long as the injected fuel preferably is in the path of the scavenge flow 83. For example, as seen in FIG. 5 at 84*a* the injectors may be positioned to spray downwardly in the direction at the port opening 82. Alternatively, as shown at 84*b*, the injectors may be mounted in the cylinder head 43 adjacent the spark plug 68 to again spray in the direction of the airflow 83. Also, the injectors may be mounted at the location 84*c* where they will be in the path of the airflow that is directed downwardly by the cylinder head 43 and in the path of the flow 83.

Figure 2:
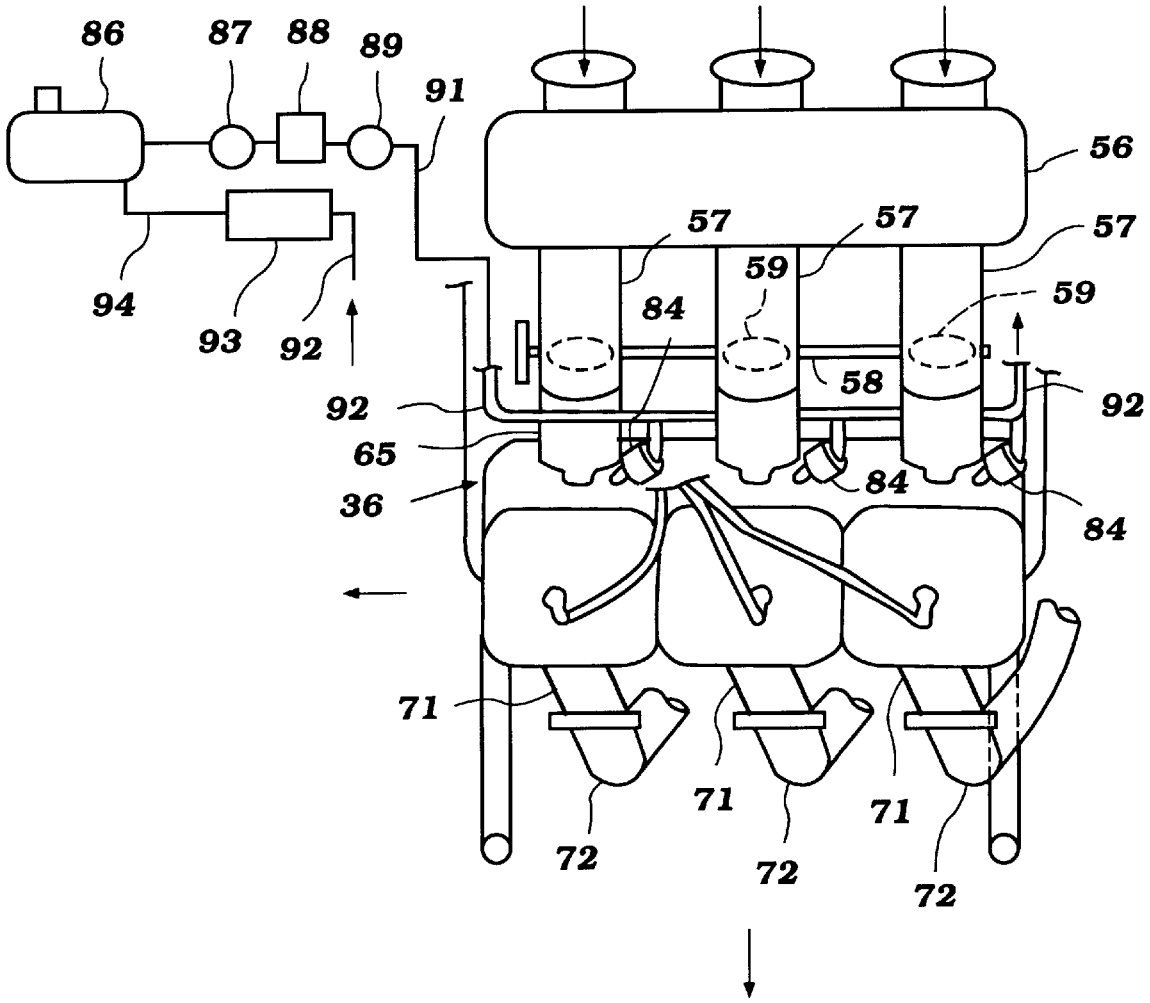
FIG. 2 is a top plan view of the engine, and shows certain of the components of the fuel supply system for the fuel injection arrangement schematically.

The fuel injectors 84 are supplied with fuel by a fuel delivery system which may be of the type shown schematically in FIG. 2. This system includes a fuel tank 86 from which fuel is drawn by a low pressure pump 87. The pump 87 may be driven either mechanically from the engine 31 or in any other manner.

The pump 87 pumps the fuel through a filter 88 to a high pressure pump 89. The high pressure pump 89 is preferably of the electrically driven type and delivers the fuel at a high pressure to a conduit 91 which, in turn, is connected a fuel rail 92 that communicates with each of the fuel injectors 84 so as to supply fuel to them. On the opposite end of the fuel rail 92 there is provided a pressure regulator 93. The pressure regulator 93 regulates the pressure at which the fuel is delivered to the injectors 84. This is done by dumping excess fuel back to the fuel tank 86 through a return line 94 in a well known manner.

Figure 4:
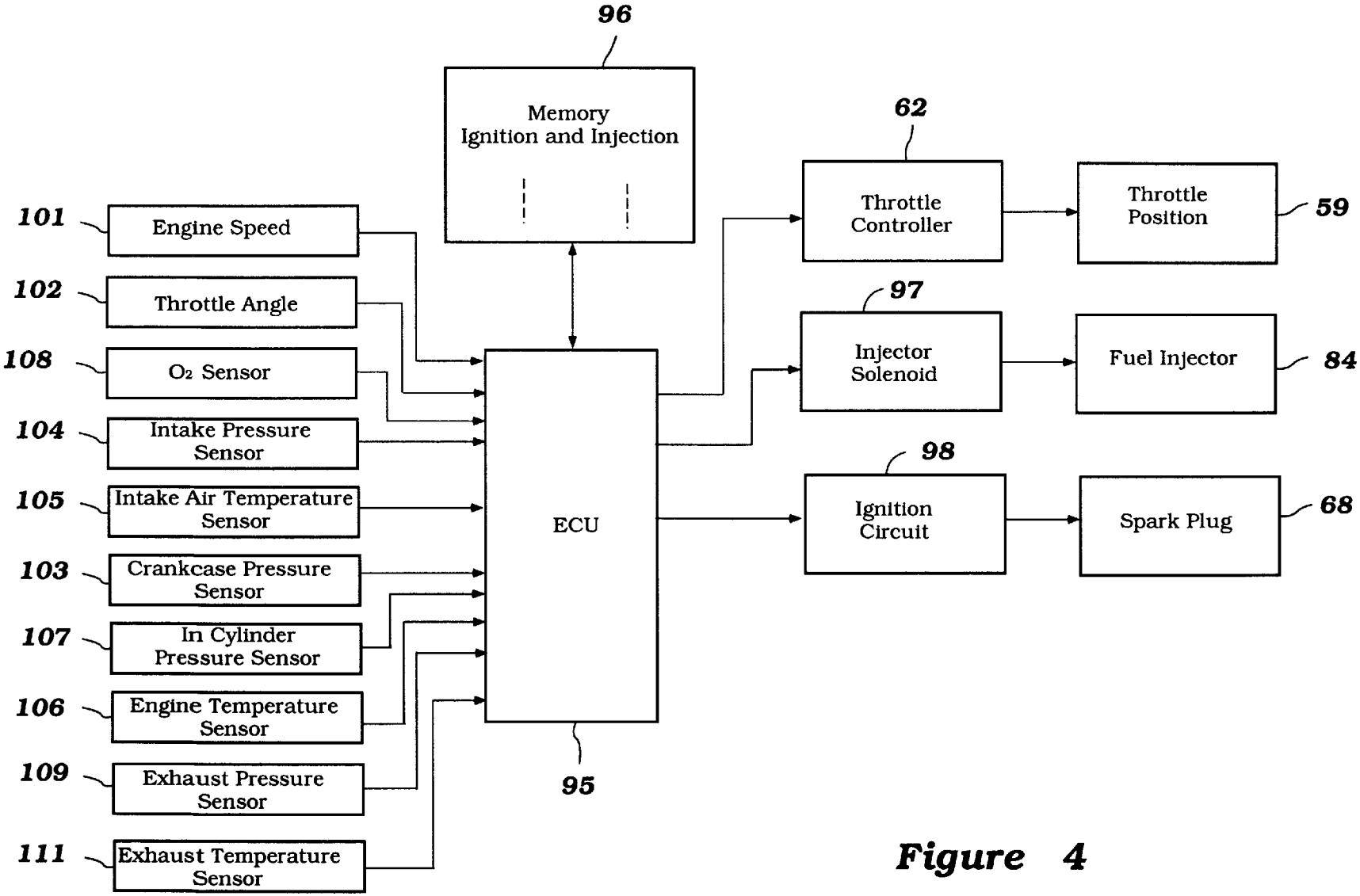
FIG. 4 is a block diagram showing the elements of the engine control so as to facilitate understanding of the operation of the engine.

The fuel injectors 84 are preferably of the electrically actuated type and are operated along with the firing of the spark plug 68 by a control system which will be described shortly by reference to FIGS. 1 and 4. Also the timing of injection also may be varried upon injector location as will be described by reference to FIG. 7.

Obviously, the positioning of the ports and more particularly the passages 71, 73, 77 and 81 is important in the design and the overall configuration of the engine. Normally in conventional engines, the centers C of the main exhaust passages 69 and the centers of the auxiliary ports 78 lie on a line L which is perpendicular to a plane A that contains the axes 38 of the cylinder bore 37. However, in accordance with an important feature of the invention, this line L is rotated through an angle Θ sufficiently so that the main scavenge passages 73 of adjacent cylinders are nested between the scavenge passages 73 and exhaust passages 71 of the adjacent cylinder as shown best in FIG. 3.

Figure 3:
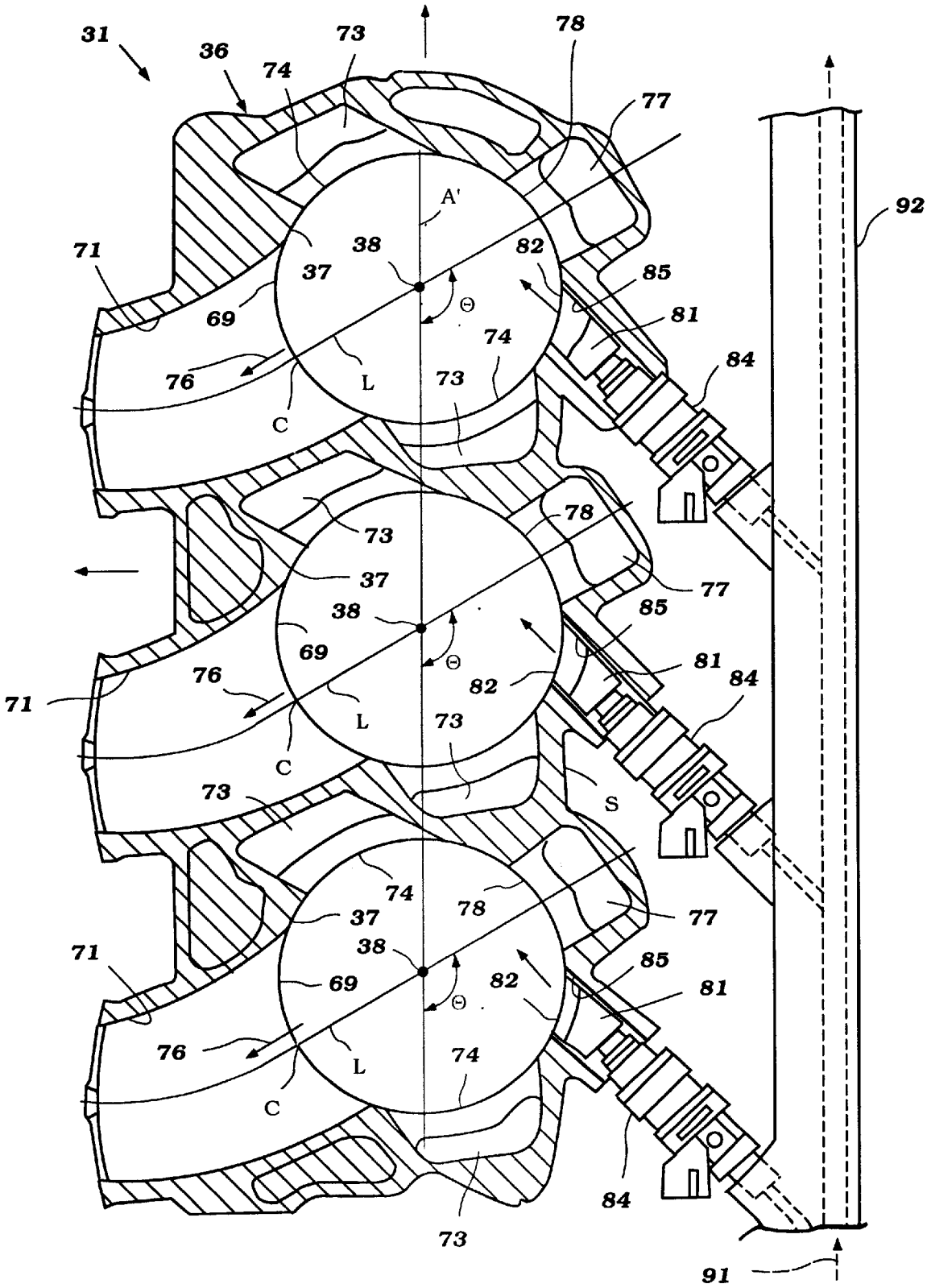
FIG. 3 is a cross-sectional view taken perpendicularly to the axes of the cylinder bores of the engine so as to show the porting and injection arrangement.

This has several advantages. First, it permits the distance between the cylinder bore axes 38 to be minimized so as to minimize the overall length of the engine. Also, this has the effect of rotating the scavenge passages 81 and specifically their horizontally extending portions 85 to an exterior surface S of the cylinder block 36 as also shown in FIG. 3. This permits the fuel injectors 81 to be positioned on the outer side of the engine where they can be easily accessed and permits placement of the fuel rail 92 in a generally parallel relationship to the plane A that contains the cylinder bore axes. Thus, a very compact construction can be provided by this arrangement and the components are all positioned where they can be easily serviced.

The control system for operating the fuel injector 84 and firing the spark plug 68 will now be described by primary reference to FIGS. 1 and 4, wherein a number of the components are shown schematically. There is provided a controller or ECU, indicated generally by the reference numeral 95, to which information is outputted from a number of sensors, as will be described. This ECU 95 also includes a memory device 96 that has memorized certain maps of ignition timing and fuel injection timing and duration.

The ECU outputs a signal to the throttle controller 62 so as to appropriately position the throttle valve 59. In addition, it outputs pulse signals to a solenoid 97 of the fuel injector 84. This solenoid operates the injection valve and controls the timing of beginning of fuel injection and the duration of fuel injection. The timing strategy will be described later by reference to FIG. 7.

Finally, the ECU outputs a signal to an ignition circuit 98 which controls the firing of the spark plug 68.

The sensors which will be described next are only typical of those sensors which may be employed with the control system and the functions which are sensed. It will be readily apparent to those skilled in the art how the system can be utilized in conjunction with other types of control.

Associated with the engine are certain engine condition sensors. These include a pulsar coil 101 which is associated with the crankshaft 39 and which provides a signal that is indicative of the crankshaft rotational position. By comparing these signals with time, it is possible to measure the actual engine rotational speed.

Engine operator demand or load on the engine may be sensed by a throttle position sensor 102 which, in turn, is associated with the twist grip throttle 63 so as to provide a signal to the ECU of this condition.

Crankcase pressure is sensed by a pressure sensor 103. It has been found that by measuring crankcase pressure at certain crank angles, it is possible to actually determine the amount of intake air volume. Associated with the intake system is an intake air pressure sensor 104 and an intake air temperature sensor 105. These sensors provide information on the inductive air for the control purposes.

Among other engine conditions which are sensed is engine temperature, this being sensed by a temperature detector 106 that is mounted so as to be in proximity with a cooling jacket of the engine. Furthermore, there is provided an in-cylinder pressure sensor 107 that actually senses the pressure in the combustion chamber.

The engine control strategy provided by the ECU 95 may also provide a feedback control so as to adjust the fuel-air ratio. If this is done, an oxygen sensor 108 may be provided that samples the combustion product in a position in proximity to the exhaust port 69.

Also associated with the exhaust system is an exhaust temperature sensor 109 and an exhaust temperature sensor 111. These signals are processed by the ECU 95 so as to control the timing of the spark plugs by controlling the ignition circuit 98 and the beginning and duration of fuel injection as controlled by the injector solenoids 97. Any desired control strategy can be employed so long as the fuel injection control meets the aforenoted parameters in connection with the engine timing and timing of opening and closing of the various scavenging ports. The strategy in connection with the fuel injection duration and timing will be described by particular reference to FIG. 7 which is a timing diagram for the engine. In this particular embodiment, the scavenge ports 74, 78 and 82 are all positioned so that they will open at the same time. It should be noted, however, that other strategies may be employed and one such alternative timing strategy is described later.

The timing of the opening of the scavenge ports 74, 78 and 82 is indicated by the line U while their closing timing is indicated by the line V. These opening closing times are after and before the opening and closing times S and T of the exhaust port 69 as is typical in two cycle engines.

Theoretically, it is possible to inject the fuel at any time during the crankshaft rotation as indicated by the area L. However, if the fuel injection timing is such that the fuel is injected directly through the supplemental scavenge port 82, it will only spray directly into the combustion chamber 45 during the time period indicated at M. However, it is possible to begin the spray of fuel into the passage portion 85 serving this port 82 before the port 82 is actually opened. When this is done, the fuel will be deposited either on the walls of the passage portion 85 or on the sliding surface of the piston which will then be scraped off and collected in the supplemental scavenge port portion 85. Thus, injection during the time period W is possible with this situation.

Thus, it is possible to supply adequate fuel for obtaining the maximum power required for the engine if fuel is injected before the scavenge port opens in this manner. During normal running and particularly under low speed low load conditions, the injection timing during the time when the scavenge port is open as indicated by the area X. This will insure that the smaller amount of fuel will be rapidly dissipated to provide the desired fuel patch by the rapidly flowing scavenge air. Also, by timing the injection to occur early in the scavenging cycle, it will be insured that no fuel will pass out of the exhaust port 69. Thus, even under maximum load condition, it is desirable to terminate injection some time before the exhaust port closes so as to minimize the likelihood of fuel escape.

As has been previously noted, it is also possible to inject fuel directly into the combustion chamber other than through the supplemental scavenge port 82. These alternative locations are illustrated in FIG. 5 and have already been referred to in describing that figure. If, however, fuel is injected directly into the cylinder and independently of the scavenge port, any time in the range L can be employed. So long as the injector is not covered by the piston during a major portion of stroke. That is, in some of the mounting locations for example those indicated at 84*a* and 84*c* in FIG. 5, the injector may be shielded from the flame of combustion during a portion of the stroke.

When mounted in the cylinder head as shown in the location 84*b*, the fuel injection timing can be at any time since the injector will never be shielded by the piston. However, when there is direct injection it is desirable so as to inject the fuel at a time when the pressure in the combustion chamber is not too high. If injection occurs into a high pressure area, then the fuel injection pressure must be high. This requires more expensive equipment and does run some risk that the fuel may deposit within the combustion chamber and not be burned.

Thus, it is preferable to utilize direct injection in the area shown at Y. This is the area when the scavenge port is open or overlaps slightly the time when the scavenge port has initially closed. If this arrangement is employed, the bulk of the fuel should be injected at the time Y1 before the exhaust port 69 closes. Some fuel may be injected thereafter but this should be the smaller amount shown at Y2.

Figure 9:
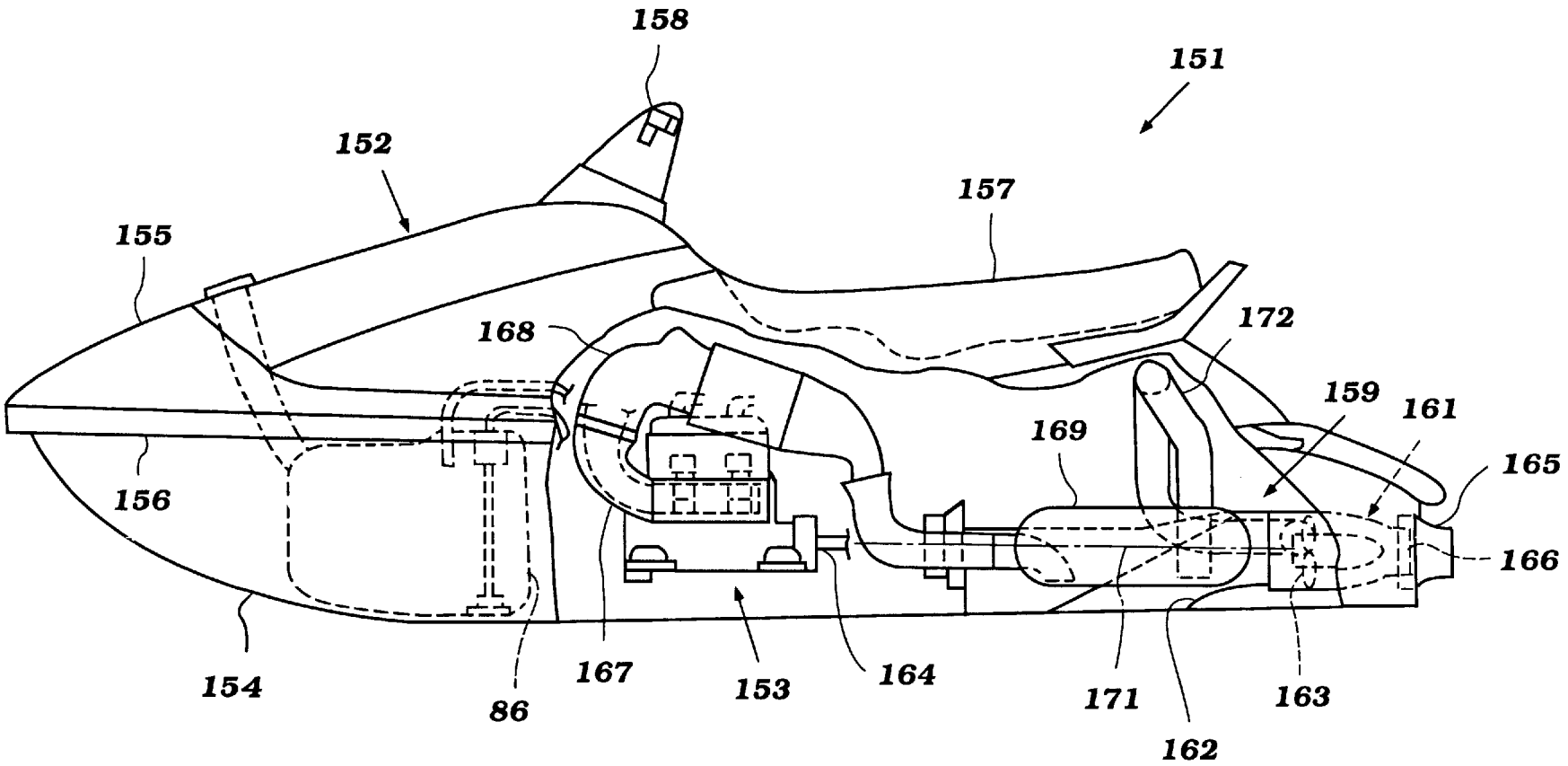
FIG. 9 is a side elevational view of a watercraft powered by an engine constructed in accordance with another embodiment of the invention, with a portion of the watercraft broken away so as to show the engine and the exhaust system.
Figure 10:
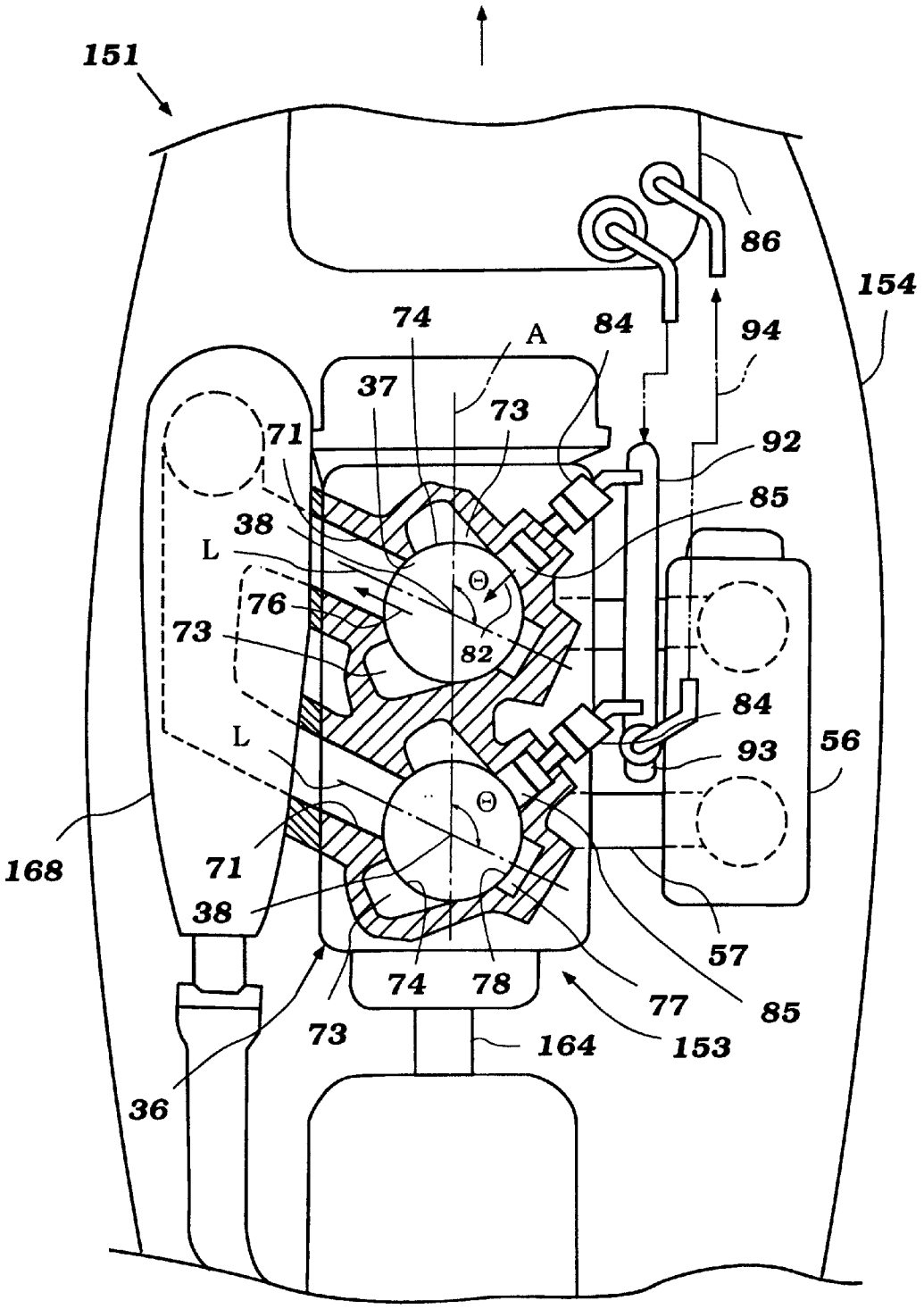
FIG. 10 is a top plan view, on a larger scale than FIG. 9 looking into the engine compartment and with a portion of the engine shown in cross-section so as to more fully understand its construction.

When describing the embodiment of FIGS. 1–8, it was pointed out that the vehicle application for the engine 31 was just typical of many applications with which the invention can be utilized. FIGS. 9 and 10 show another embodiment wherein the invention is utilized in conjunction with a small watercraft typically referred to as a "personal watercraft", and indicated generally by the reference numeral 151. The watercraft 151 includes an engine compartment formed by a hull assembly 152.

Position within this engine compartment is a two cycle in-line crankcase compression internal combustion engine indicated generally by the reference numeral 153. Except for the positioning of certain of the ancillary or auxiliary component and the fact that the engine 153 in this embodiment is of a two-cylinder in-line type rather than a three-cylinder cylinder in-line type, the engine has a construction as aforedescribed. Therefore, where components of this engine 153 have the same or substantially the same construction as that previously described, they have been identified by the same reference numeral. These components will be referred to again only insofar as is necessary to understand the construction and operation of this embodiment.

The watercraft hull 152 is formed from a suitable material such as a molded fiberglass reinforced plastic or the like, and is comprised of a lower hull portion 154 and an upper deck portion 155. The hull portions 154 and 155 have mating interlock edges 156 that are bonded together so as to form a water-tight assembly.

The particular type of watercraft illustrated has a passenger's area in which a single longitudinally extending seat 157 is provided. One or more riders sit on the seat 157 in straddle fashion. If more than one rider is accommodated, the riders are seated in tandem.

A control handle bar assembly 158 is provided forwardly of the seat 157. This handle bar assembly 158 includes a steering mechanism for steering a jet propulsion unit 159 that is driven by the engine 153 in a manner which will be described. In addition, a throttle control for controlling the speed and power output of the engine 153 is also provided.

Referring primarily to FIG. 9, the jet propulsion unit 158 is of a conventional type having an outer housing 161. This outer housing 161 and the hull portion 154 define a water inlet opening 162 through which water may be drawn. This water is drawn an impeller 163 that is affixed to an impeller shaft which is coupled to an impeller drive shaft 164 in a suitable manner.

Water drawn by the impeller 163 is discharged rearwardly through a pivotally supported discharge nozzle 165 for propelling the watercraft. The discharge nozzle 165 cooperates with a discharge port 166 of the outer housing 161 in a manner well known in this art. The handlebar assembly 158 controls the position of the nozzle 165 in a known manner.

As has been noted, the engine 153 is basically of the type of configuration as aforedescribed, except for the fact that it has two cylinder bores 37 as opposed to the three aligned cylinder bores of the engine 31 of the previous embodiment. However, the configuration and orientation of the porting is the same as that already described and, therefore, a further description of it is not believed to be necessary.

In this embodiment, the fuel tank 86 is disposed forwardly of the engine 153 in the hull 152. The fuel supply system is basically the same and some of the same components are illustrated and identified by the same reference numeral.

This embodiment also includes a typical watercraft exhaust system. This includes a water-cooled exhaust manifold 167 that receives the exhaust gases from the cylinder block exhaust passages 71. These exhaust gases are then transferred upwardly and rearwardly to a combined expansion chamber and water trap device 168. The exhaust gases are then delivered rearwardly and downwardly to a water trap device 169 which is employed in a manner typical in watercraft usage.

The water trap device 169 is disposed on one side of and substantially on a common horizontal plane with the rotational axis 171 of the impeller shaft for the impeller 163 and the impeller drive shaft 164. A U-shaped trap section 172 delivers exhaust gases from the water trap device 169 to a discharge in a tunnel of the hall which contains the jet propulsion unit 159.

Figure 11:
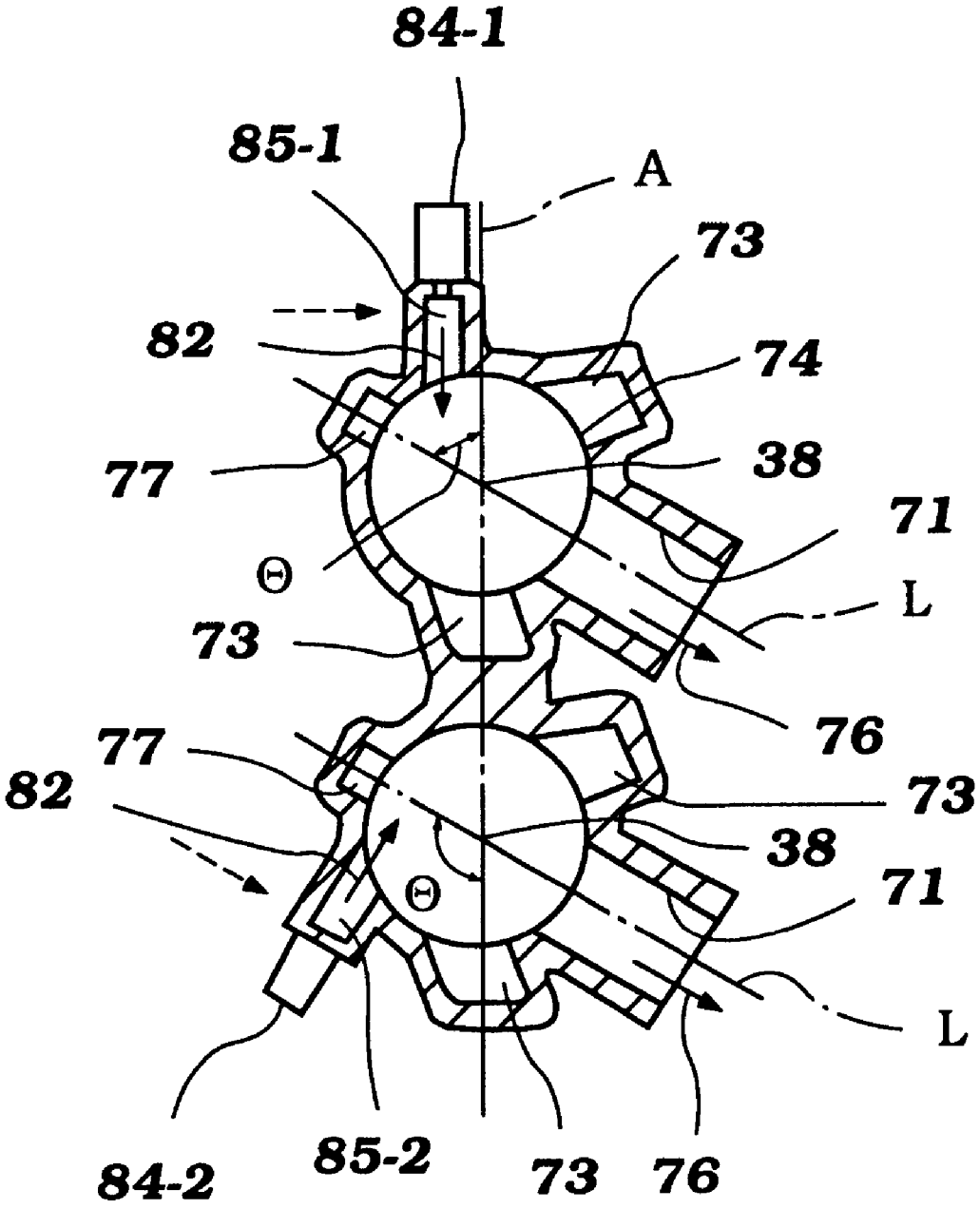
FIG. 11 is a cross-sectional view, in part similar to FIG. 10 and shows an alternative arrangement for locating the supplemental scavenging passages and the associated fuel injectors.

In the embodiments thus far described, the ports and passages associated with each of the cylinder bores 37 have been symmetric although rotated about the cylinder bore axis 38 through the angle θ. In other words, all of the fuel injectors 84 have been disposed on the same side of the cylinder bore and extending in generally the same direction. Of course, one of the advantages of the construction as thus far described is the fact that the fuel injectors 84 by this arrangement and the supplemental scavenge passages 81 may be positioned on an external surface such as the surface S of the cylinder block. However, this can be accomplished in other ways, particularly with two-cylinder engines, without having each cylinder being totally symmetric. FIG. 11 shows one way in which this can be done.

Since the only difference between this embodiment and those previously described is the orientation of the supplemental scavenge passages 81 and the fuel injectors 84 associated therewith, only a single view is believed to be necessary to illustrate this embodiment and the components which are the same as those previously described have been identified by the same reference numeral. In this embodiment, however, the components associated with the supplemental scavenge passages 81, their ports 82 and the horizontal extending portions 85, have been identified with the subscript −1 and −2 so as to discriminate between the cylinders with number 1 cylinder being shown at the top of this view, and number 2 cylinder being shown at the bottom.

It will be seen that the supplemental scavenge passage 85-1 is positioned in the area at one end of the engine. The supplemental scavenge passage 85-2 of the remaining cylinder is disposed so that it is at the opposite end of the engine. This construction still provides all of the features as aforenoted, and it should be noted that each supplemental passage will cooperate with the adjacent main scavenge passage 73 and its port 74, so as to achieve the aforenoted flow redirecting effect.

Figure 12:
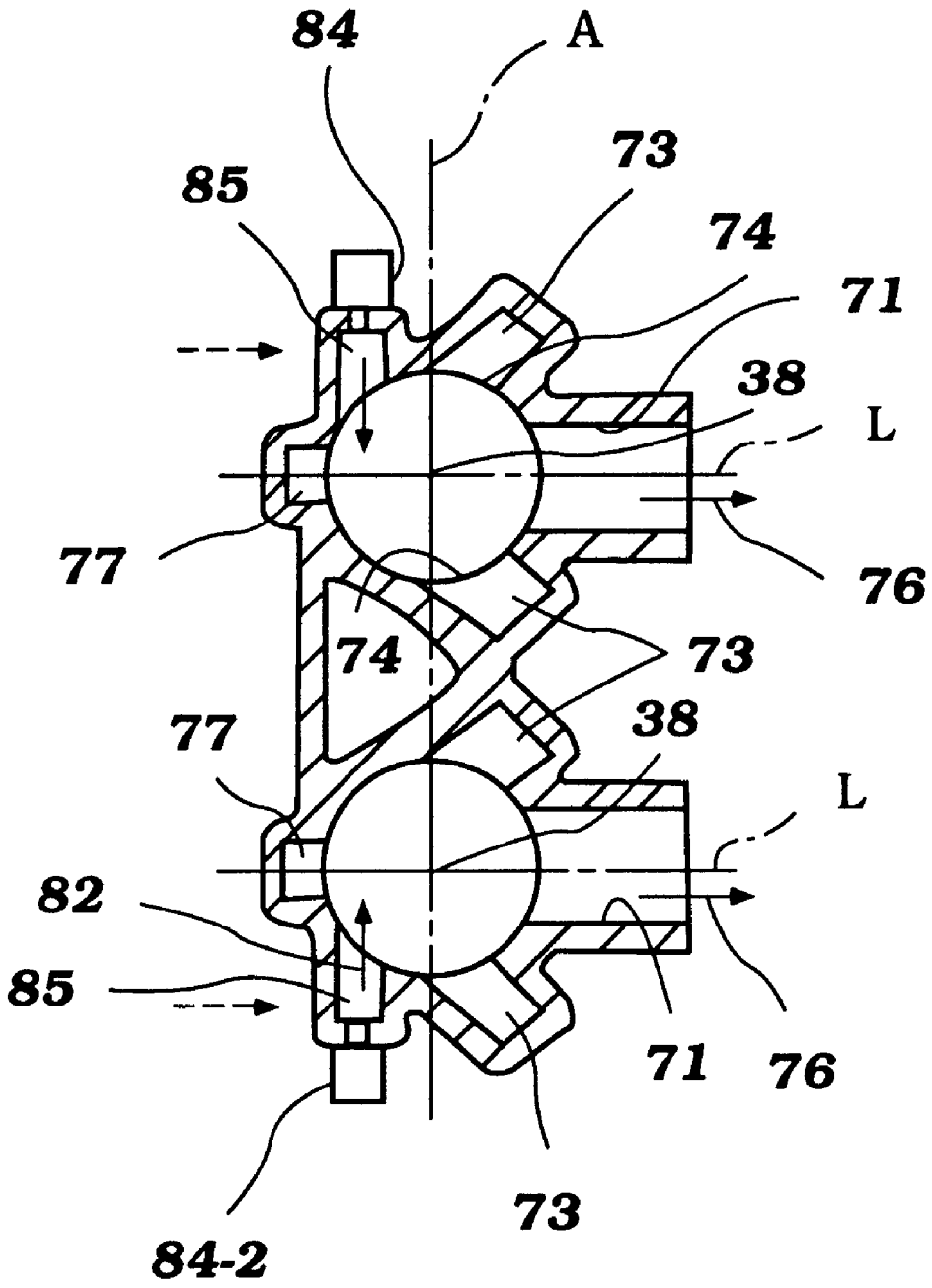
FIG. 12 is a cross-sectional view, in part similar to FIGS. 10 and 11 and shows another arrangement for locating the supplemental scavenging passages and fuel injectors.

FIG. 12 is a view that is substantially similar to FIG. 11. Because of this, components in this embodiment which are the same as that embodiment have been identified by the same reference numeral.

In this embodiment, it will be seen that the port arrangement and passage arrangement has been arranged so that rather than being offset at the angle θ, the center lines L between the center of the auxiliary scavenge passage 77 and the exhaust passage 71 are at right angles and more conventionally arranged. This embodiment, therefore, does not have the advantage of the more compact instruction but places the fuel injectors 84-1 and 84-2 in an orientation so that they will be parallel to the plane A that contains the cylinder bore axis 38. This position is particularly useful with two-cylinder engines because it places each fuel injector at the end of the cylinder block where it can be conveniently accessed.

Figure 13:
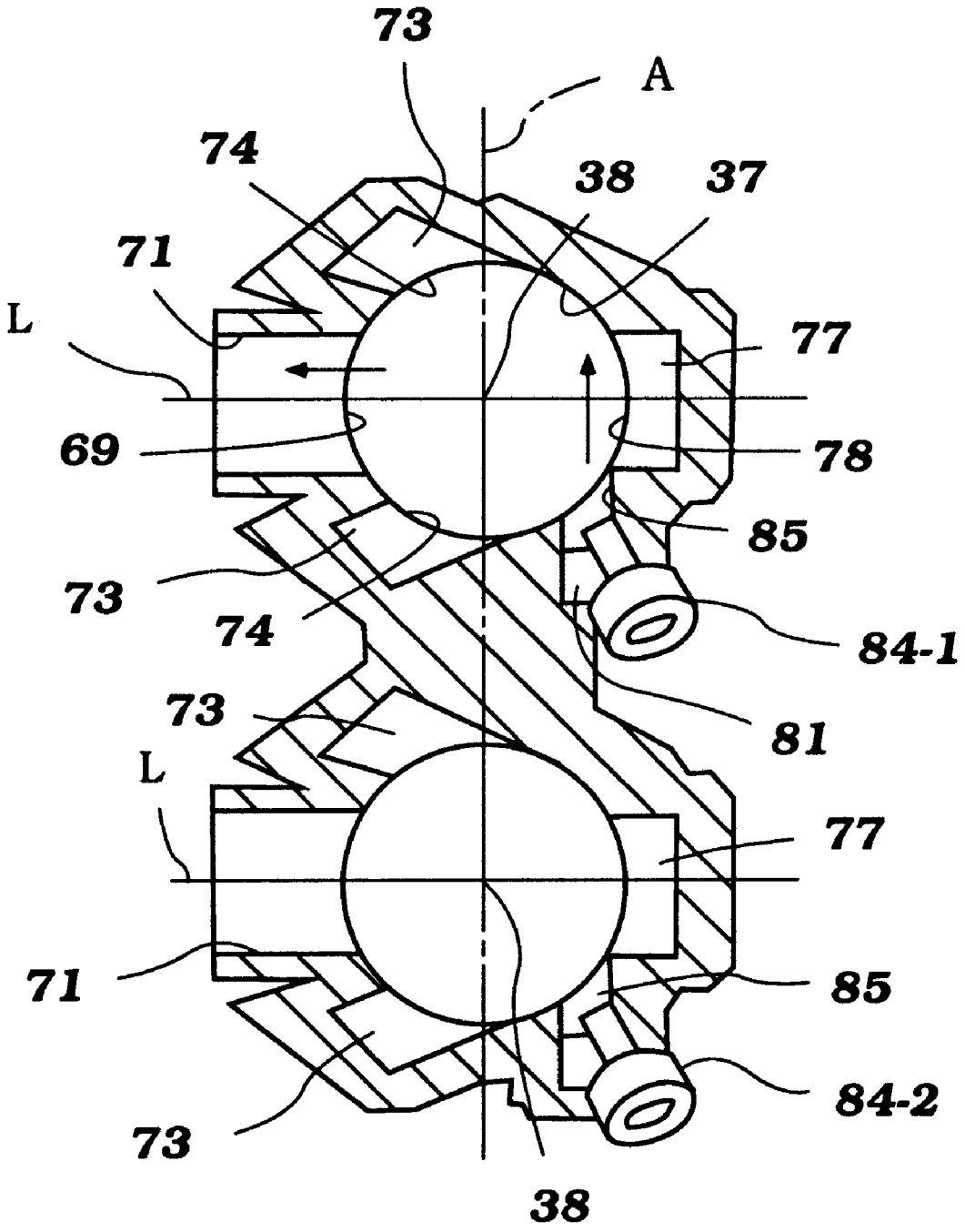
FIG. 13 is a cross-sectional view, in part similar to FIGS. 10–12 and shows yet another layout for the ports.

FIG. 13 is a view of another embodiment which has the non-rotated port configurations as shown in FIG. 12. In this embodiment, however, the fuel injectors 84-1 and 84-2 are provided in a symmetrical relationship and thus, both extend in the same direction. Aside from these differences, this embodiment is the same as that previously described and further description of it and/or of its components is not believed to be necessary to understand the construction and operation of this embodiment.

Claims 14–16 show another embodiment of the invention. This embodiment differs from those previously described in showing another type of propulsion application for the engine. In addition, this embodiment illustrates how the invention can be employed with an engine having V-type or oppose-type cylinder banks with more than one cylinder in each bank. In many regards, the layout of the scavenging system and its relationship to the exhaust system for each cylinder is similar to that previously disclosed. Where that is the case, those components will be identified by the same reference numerals and will be described again only insofar as necessary to understand the construction and operation of this embodiment. Also, in this embodiment, the individual components associated with each cylinder have the same construction and thus, have been identified by the same reference numeral.

Figure 14:
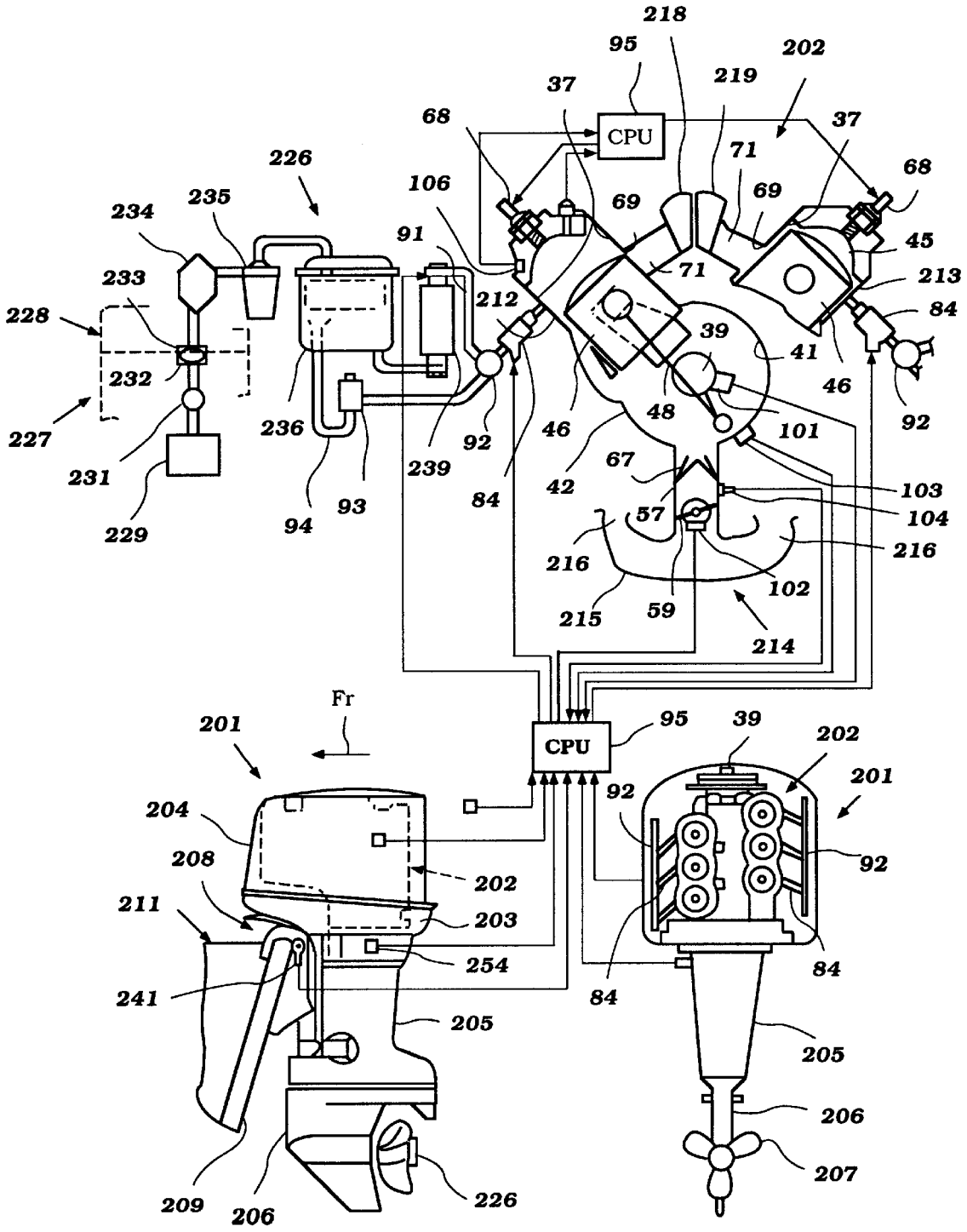
FIG. 14 is a three part view of an outboard motor constructed in accordance with another embodiment of the invention with the top view showing the engine of the outboard motor in schematic cross-section along with its associated fuel supply system. The lower left hand view shows the outboard motor attached to the transom of a watercraft, shown partially. The final view of this figure, shows the rear end of the outboard motor with a portion of the protective cowling broken away so as to more clearly show the engine construction and layout. In addition, the controller for the engine control system links these three views together.

Referring now to these figures and initially to FIG. 14, an outboard motor constructed in accordance with this embodiment of the invention is identified generally by the reference numeral 201. The outboard motor 201 includes a V6-type two cycle crankcase compression engine, indicated generally by the reference numeral 202 and which is constructed and operated in accordance with the invention.

The outboard motor 201 is provided with a power head assembly in which the engine 202 is supported. This power head assembly includes, in addition to the engine 202, a protective cowling comprised of a lower tray portion 203 and a detachable main cowling portion 204. As is typical with outboard motor practice, the engine 202 is mounted in the power head so that the crankshaft 39 rotates about a vertically extending axis.

This crankshaft is coupled to a drive shaft (not shown) that depends into and is journalled within a drive shaft housing 205. A lower unit 206 at the lower portion of the drive shaft housing 205 includes a transmission, which may include a forward neutral reverse mechanism for driving a propeller 207 in selected forward and reverse directions.

A clamping and swivel bracket assembly, indicated generally by the reference numeral 208, is associated with the drive shaft housing 205 so as to connect the outboard motor 201 to a transom 209 of an associated watercraft which is shown partially and which is indicated generally by the reference numeral 211.

This swivel and clamping bracket assembly 208 permits tilt and trim movement of the outboard motor 201 about a horizontally disposed axis. In addition, the swivel bracket portion is connected to a steering shaft fixed to the drive shaft housing 205 to permit steering of the outboard motor 201 about a vertically extending axis. Since these constructions are may be of any conventional type and are not necessary to understand the construction and operation of the invention, reference may be had to any known structure for details that can be utilized to practice the invention.

As has been noted, the engine 202 has the same basic construction as any of the embodiments thus far described and basically may be considered to be two three-cylinder inline type engines connected together to a common crankcase 42. Thus, the cylinder block assembly is divided into first and second cylinder banks 212 and 213, each of which is formed with three cylinder bores 37 in which pistons 46 reciprocate. These pistons 46 are connected by respective connecting rods 48 to the crankshaft 36 in some instances in side-by-side fashion.

An air induction system, indicated generally by the reference numeral 214, is provided for delivering an intake air charge to the individual crankcase chambers 41 which are associated with each of the cylinder bore 37. This induction system includes an air inlet device 215 that has openings 216 that open into the interior of the protective cowling and which induct air that has been admitted through an air inlet in the outer cowling and specifically the upper cowling 204 thereof in a manner known in this art.

In this V-type embodiment, exhaust ports 69 of the cylinder bank 212 are reversed from those of the exhaust port of the cylinder bank 213 so that the exhaust ports 69 all open into a valley 217 that is formed between the cylinder bank. As is typical with outboard motor practice, the exhaust passages 71 of these two cylinder banks merge into common collector sections 218 and 219, each of which collects the exhaust gases from the respective cylinder bank 212 and 213.

Figure 15:
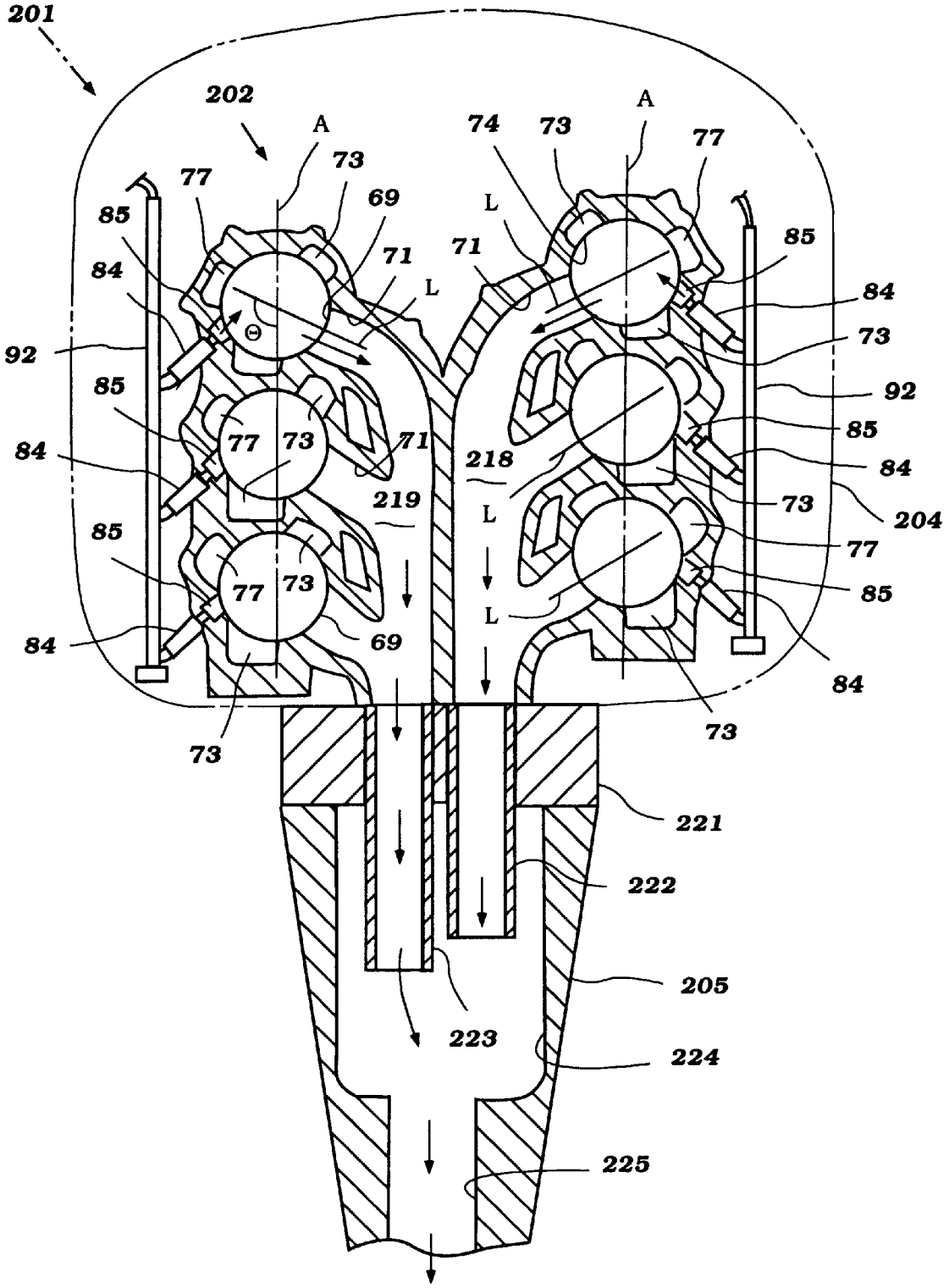
FIG. 15 is an enlarged view looking generally in the direction of the lower right-hand view of FIG. 14 but shows the engine in cross-section.

As best seen in FIG. 15, these two collector sections 218 and 219 extend in parallel downward direction toward an exhaust guide 221 positioned at the upper end of the drive shaft housing 205 and upon which the engine 202 is mounted.

A pair of exhaust pipes 222 and 223 depend from this exhaust guide and the respective collector sections 218 and 219 into an expansion chamber 224 formed in the upper end of the drive shaft housing.

This expansion chamber 224 functions to silence the exhaust gases through the expansion and subsequent contraction into an exhaust passage 225 in the drive shaft housing 205 that communicates with an underwater exhaust gas discharge. In the illustrated embodiment, this is constituted through the hub exhaust gas discharge 226 shown in the lower left-hand view of FIG. 14.

In addition, above-the-water idle discharge is also provided. Since this type of exhaust system is well-known in the art, it will not be described further. It will be readily apparent to those skilled in the art how the invention can be practiced with a wide variety types of exhaust systems normally employed in marine applications.

The fuel supply system will also be described since it differs slightly from those previously described and is particularly adapted for outboard motor application. This fuel supply system is indicated generally by the reference numeral 226 and includes a first portion, indicated generally as 227, that is mounted in the watercraft hull 211 and a second portion 228 that is mounted on the power head of the outboard motor 201 and specifically within the protective cowling formed by the cowling members 203 and 204.

The hull mounted side 227 includes a relatively large fuel storage tank 229 that is mounted in an appropriate location within the hull 211. A primary fuel pump 231 draws fuel from this tank 229 and delivers it to a hull side section 232 of a quick disconnect coupling. This section 232 mates with an engine-mounted side of the coupling 233. By the way, it should be noted that the structure now being described appears not only in FIG. 14 but also in the schematic view of FIG. 16.

An engine-mounted low pressure fuel pump 234 which may be mechanically driven from the engine 202 or which may be driven by the pressure pulses in the crankcase chambers 41 receives this fuel and transfers it to a fuel filter 235 where the fuel is filtered. The fuel is then delivered to a vapor separator 236 which is of a known type and in which a needle-operated valve 237 controlled by a float 238 admits fuel to the separator 236 to maintain a constant head of fuel therein.

Figure 16:
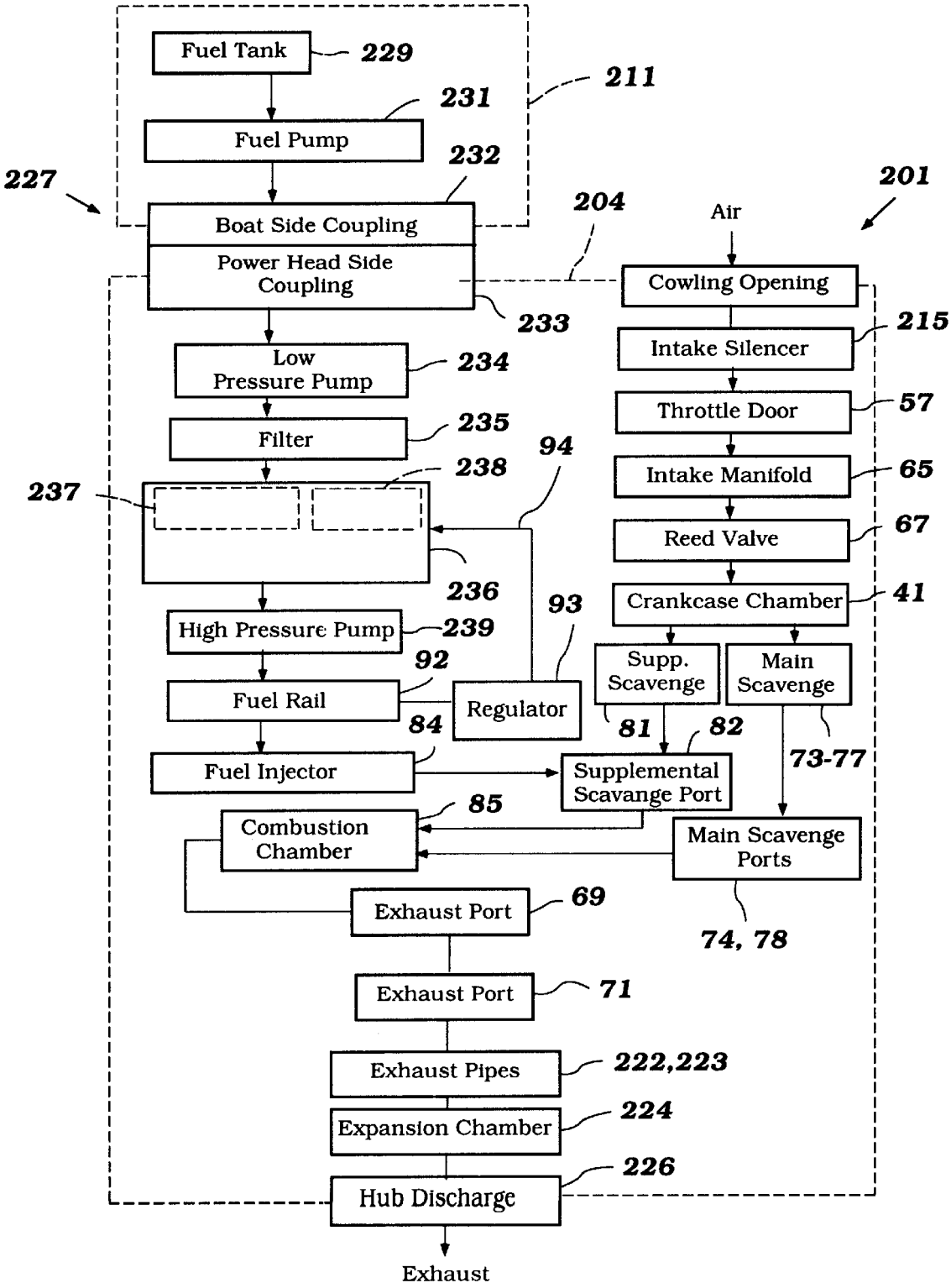
FIG. 16 is a schematic block diagram showing the components of the induction, charge forming and exhaust systems for the engine.
Figure 17:
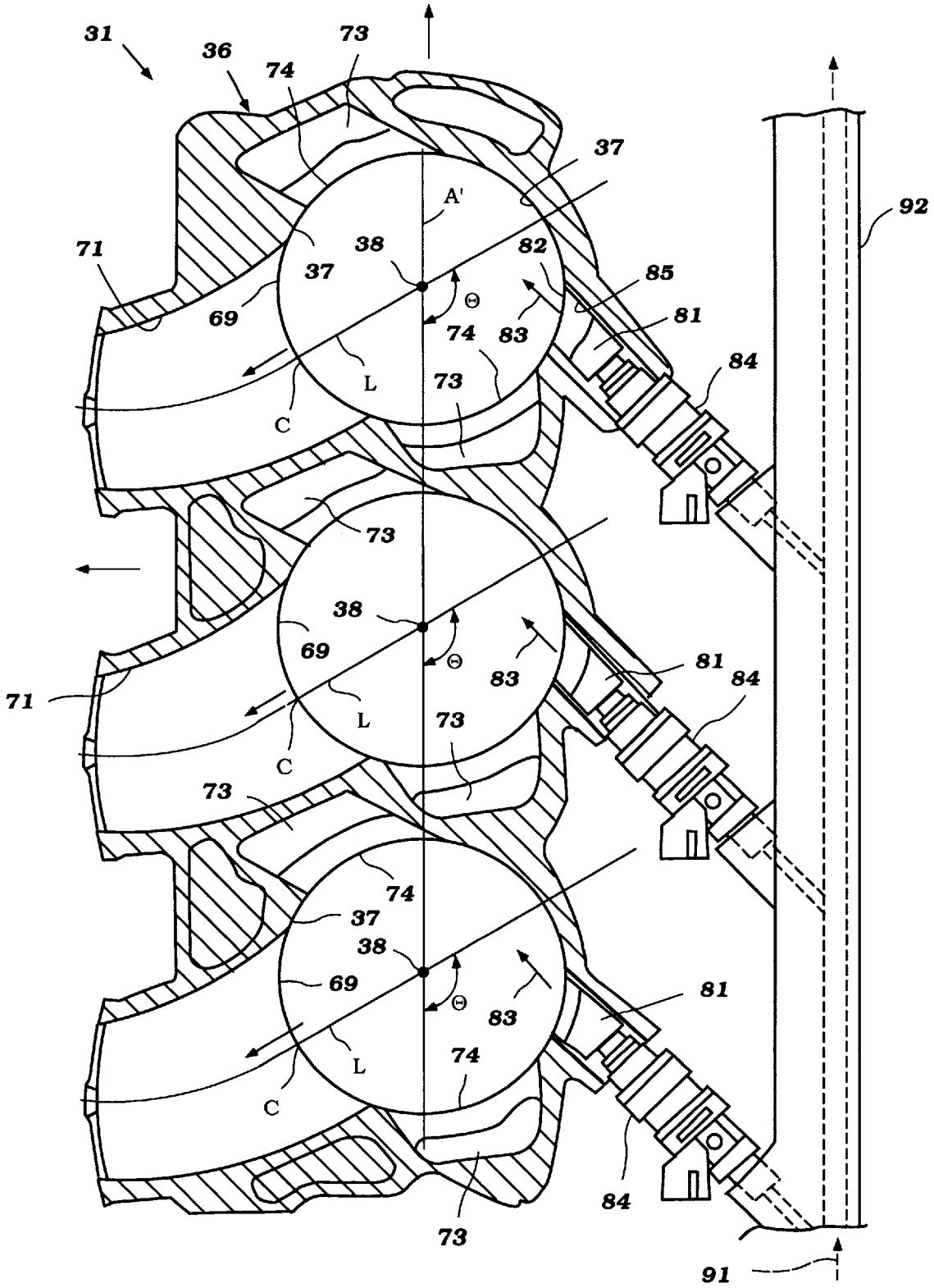
FIG. 17 is a view, in part similar to FIG. 3, but shows another embodiment of porting and scavenging arrangement.
Figure 18:
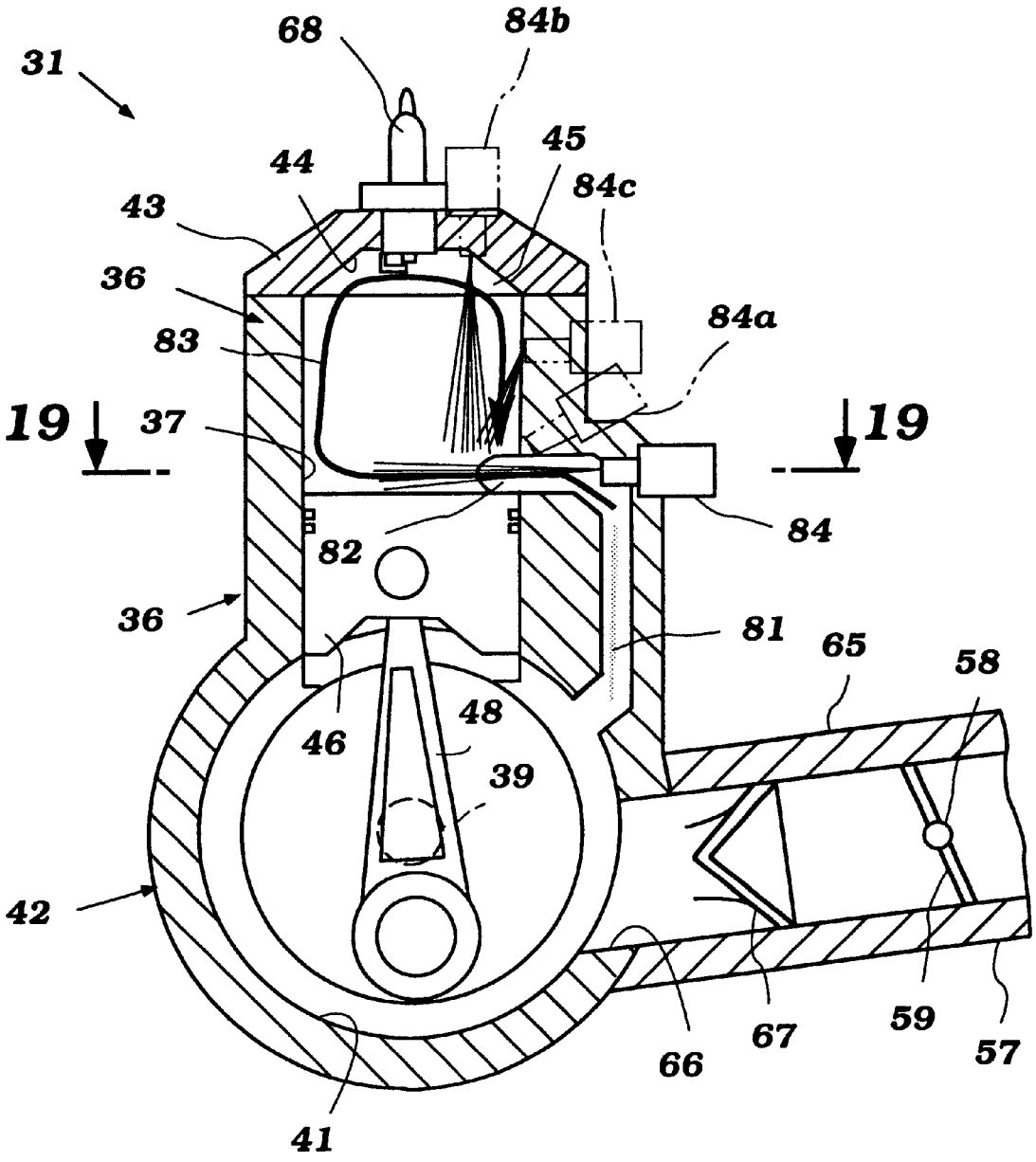
FIG. 18 is a view, in part similar to FIG. 5, and shows another type of porting arrangement.
Figure 19:
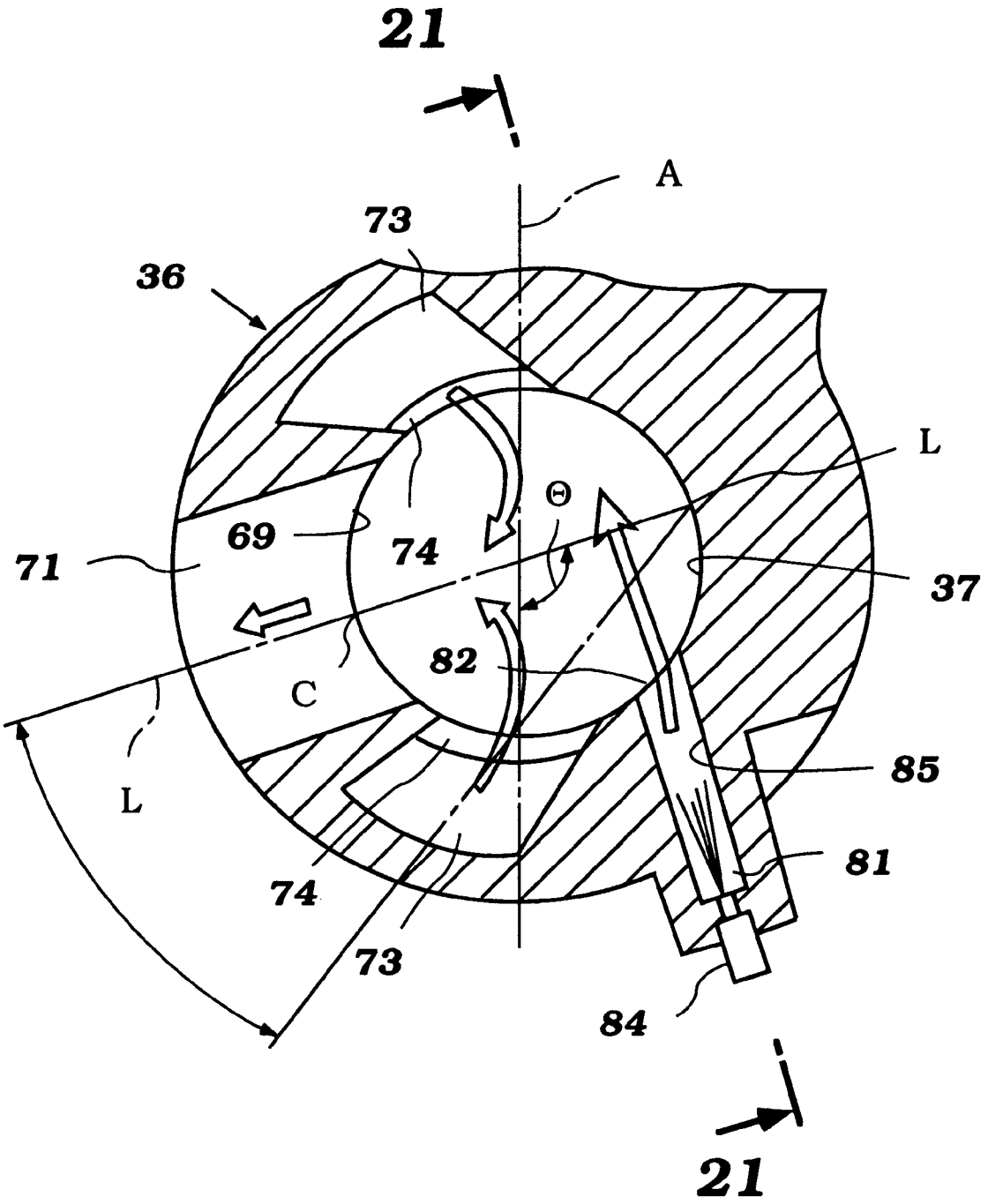
FIG. 19 is a cross-sectional view, in part similar to FIG. 6, and shows another porting arrangement.
Figure 20:
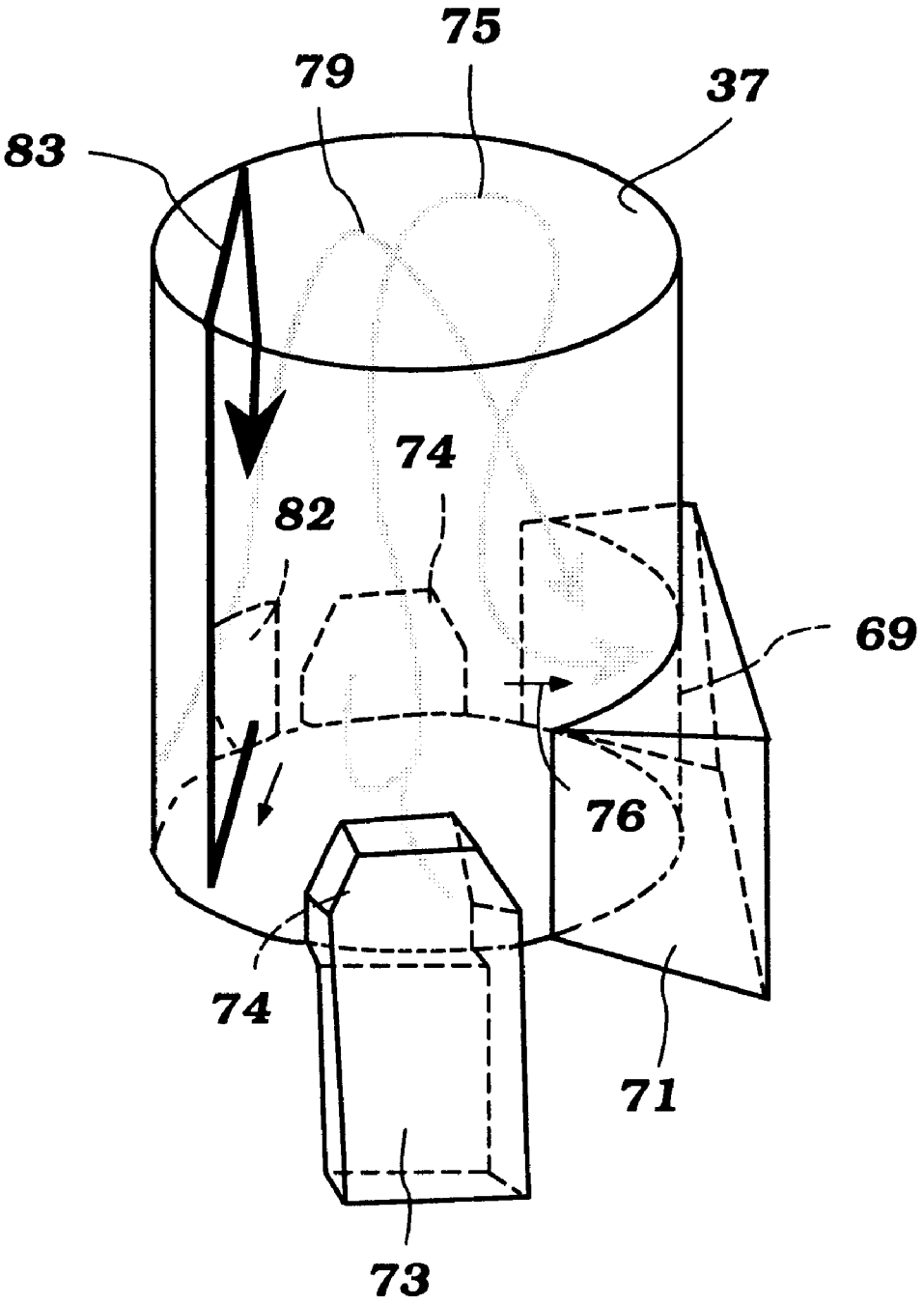
FIG. 20 is a view, in part similar to FIG. 8, and shows the air flow pattern with the porting arrangement of FIG. 19.

A second high-pressure fuel pump 239, shown separately in FIGS. 14 and 16, but which actually is preferably mounted within the fuel vapor separator 236, delivers the fuel under pressure to the fuel rails 92 associated with each of the cylinder banks 212 and 213. At the ends of these fuel rails 92, there is provided the pressure regulator 93 which regulates the fuel pressure by dumping it back, in this case, into the fuel vapor separator 236 through the return line 94.

Aside from these described differences, the system is the same as that previously described. However, because of the marine application, there is also provided sensors for engine control of the CPU 95 that are unique to the such applications. These include a trim angle sensors 241, a transmission condition sensor 242 and some or all of the sensors previously described.

From the foregoing description, it should be readily apparent that the invention is capable of being utilized in a wide variety of engine types that have two or more cylinders in line with each other and which are utilized for a wide variety of powering purposes.

In each embodiment thus far described, the engine has been provided with two main scavenging passages and ports that are disposed on opposite sides of the exhaust port and passage and an auxiliary scavenging port that is disposed diametrically opposite the exhaust port. In each embodiment, an supplemental flow redirecting scavenge port has been provided with an associated passage. This port serves the function of redirecting the flow and facilitating stratification of the fuel charge to preclude it from being discharged from the exhaust port. Various arrangements have been described utilizing this basic concept.

Next will be described a series of embodiments which are generally the same as those previously described but wherein the auxiliary main scavenge passage and port has been deleted. Because this is the only difference between these embodiments and the corresponding embodiments already described, these additional embodiments will only be described by reference to the corresponding earlier figures from which they depart. As noted, the only difference is the deletion of the auxiliary main scavenge passage.

The first of these embodiments appears in FIGS. 17–20. These figures correspond to FIGS. 3, 5, 6 and 8 of the embodiment of FIGS. 1–8. As noted above, these figures distinguish from the earlier embodiment and the deletion of the auxiliary main scavenge passage 77 and auxiliary main scavenge port 78.

Figure 21:
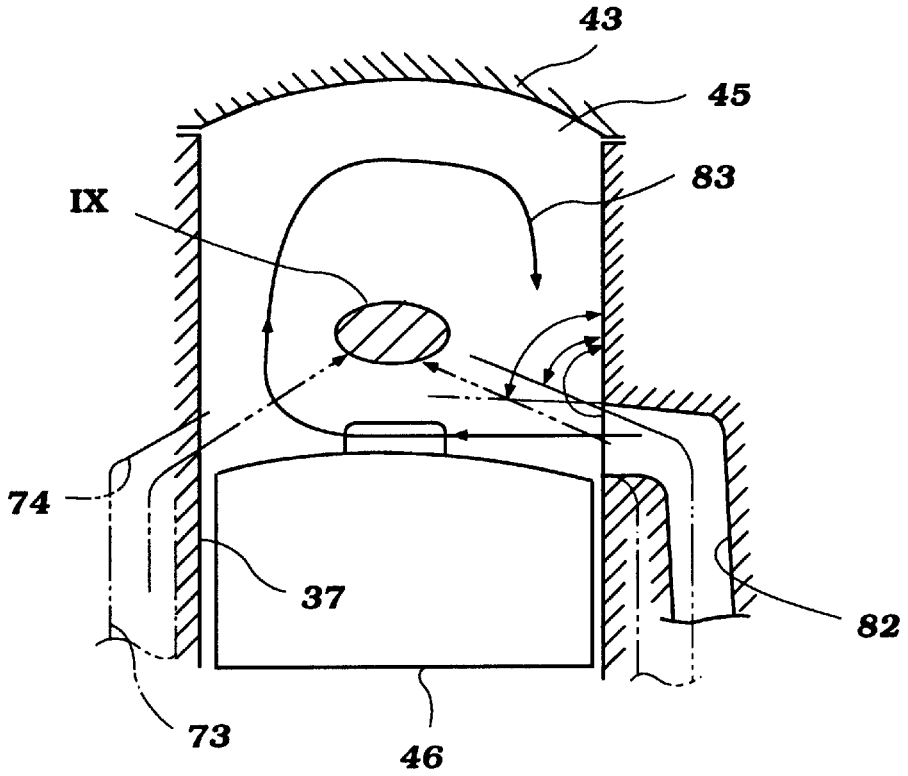
FIG. 21 is a cross-sectional taken along the line 21—21 of FIG. 19.
Figure 22:
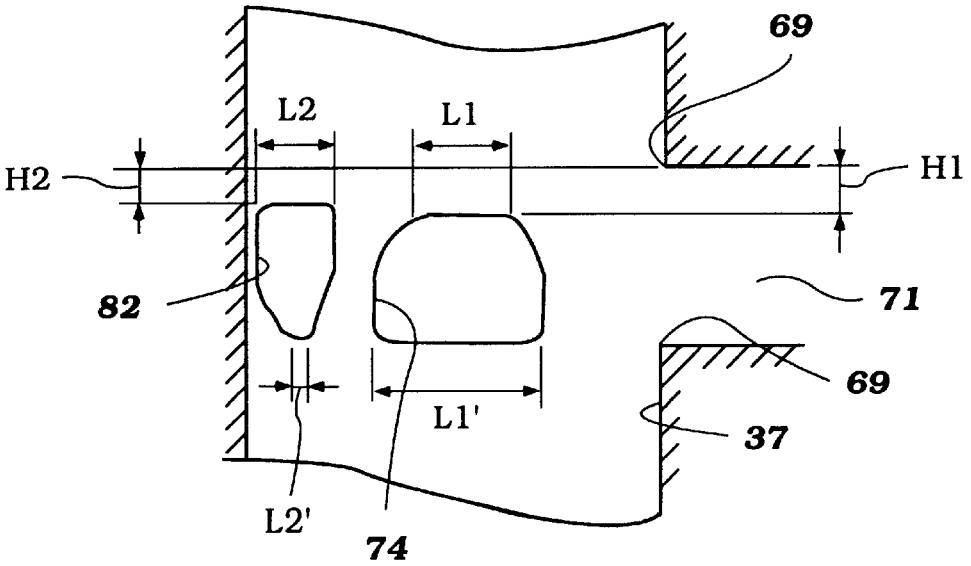
FIG. 22 is a developed view of the cylinder bore showing the timing arrangement between the exhaust port and the scavenging ports.

With this embodiment, however, there is also a difference in the timing of opening of the scavenge ports. In the previously described embodiments, all scavenge ports opened at the same time. In this embodiment, however, the main scavenge ports 74 are staggered so that they will open at a slightly later time than the supplemental scavenge port 82 as best seen in FIGS. 21 and 22. Also, the scavenge ports are configured so that the supplemental scavenge port 82 has a relatively wider upper portion than its lower portion as indicated by the dimensions L2 and L2'.

Thus, upon initial opening of the scavenge ports 82, there will be a greater flow area. However, on closing, there will be a smaller restriction initially and then greater at the end. In other words, a longer flow duration is provided with the larger flow areas.

With the main scavenge ports 74, on the other hand, they open later than the supplemental scavenge port 82. This is because the distance between their upper edge H1 and the opening of the exhaust port is greater than the distance H2 between the upper edge of the exhaust port 69 and the upper edge of the supplemental scavenge port 82.

Also, the upper edge distance L1 is less than the lower edge distance L2 and hence, a more restricted flow will occur initially and at the end. Thus, more air will be drawn into the supplemental port 82 initially and this flow will continue longer. This aids in stratifying the fuel mixture as shown by the patch IX in FIG. 21. In all other regards, this embodiment is constructed and operates the same as the previously described embodiments.

Figure 23:
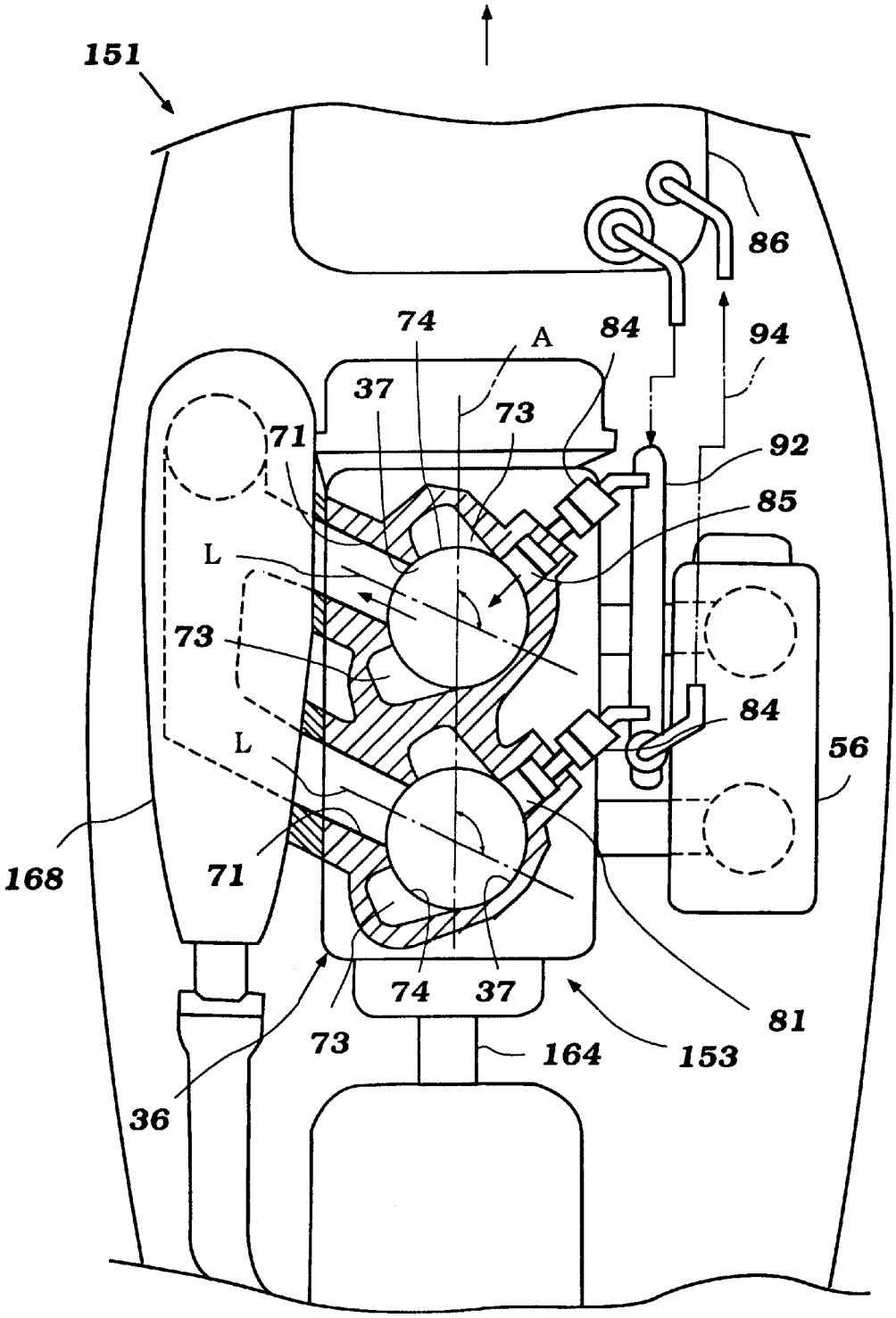
FIG. 23 is a view, in part similar to FIG. 10, and shows another porting and scavenging arrangement.

FIG. 23 is an embodiment which is basically the same as the embodiments of FIGS. 9 and 10. Again, however, the auxiliary main scavenge passage 77 and auxiliary main scavenge port 78 is deleted.

Figure 24:
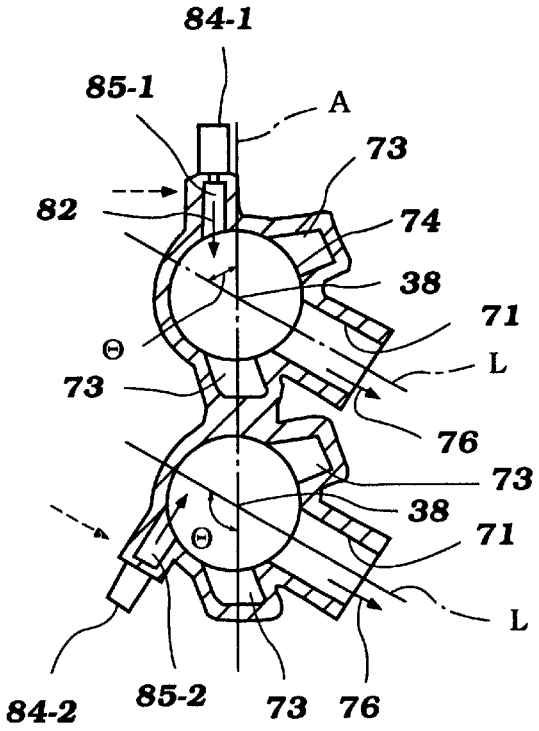
FIGS. 24–26 are cross-sectional views, in part similar to the cross-sectional view of FIG. 23, and are related to FIGS. 11–13 and show other porting and scavenging arrangements.
Figure 25:
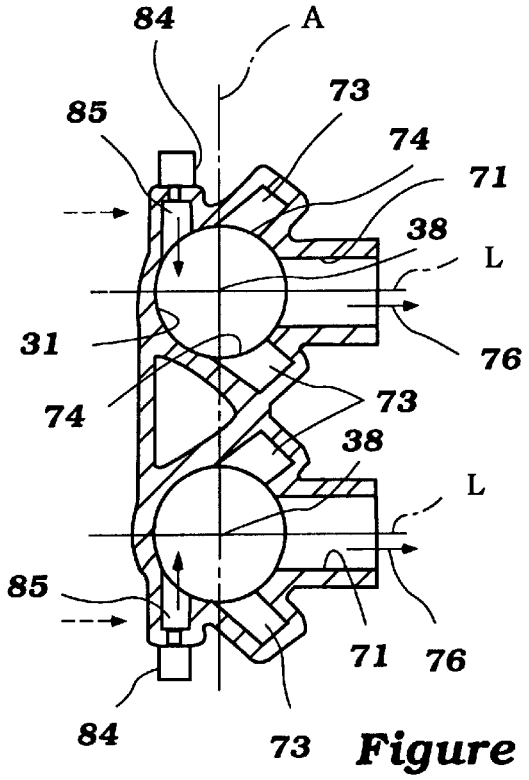
Figure 26:
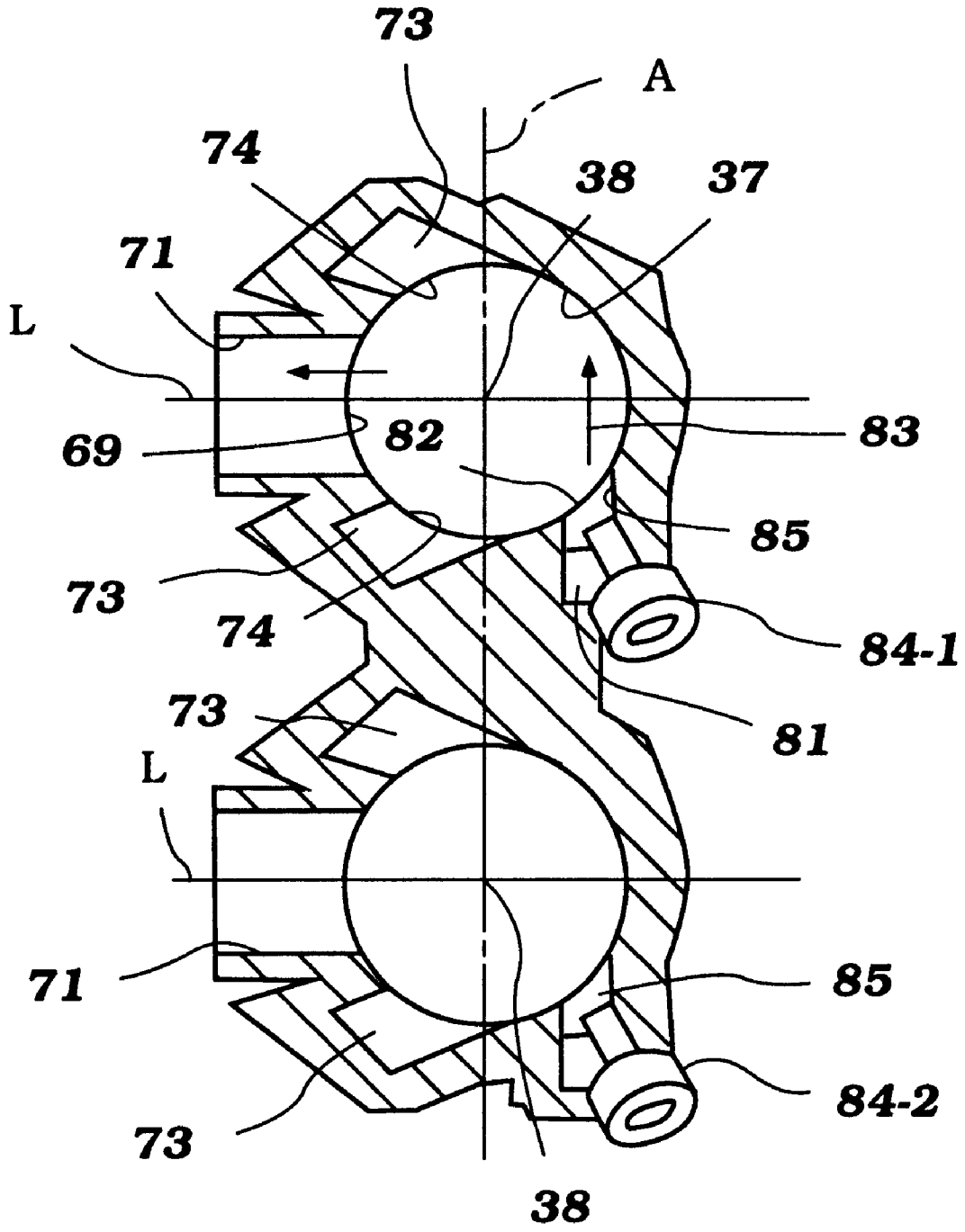

FIGS. 24–26 are the same as the embodiments of FIGS. 11–13, respectively, and have the same differences. That is, the auxiliary main scavenge passage 77 and scavenge port 78 is deleted.

Figure 27:
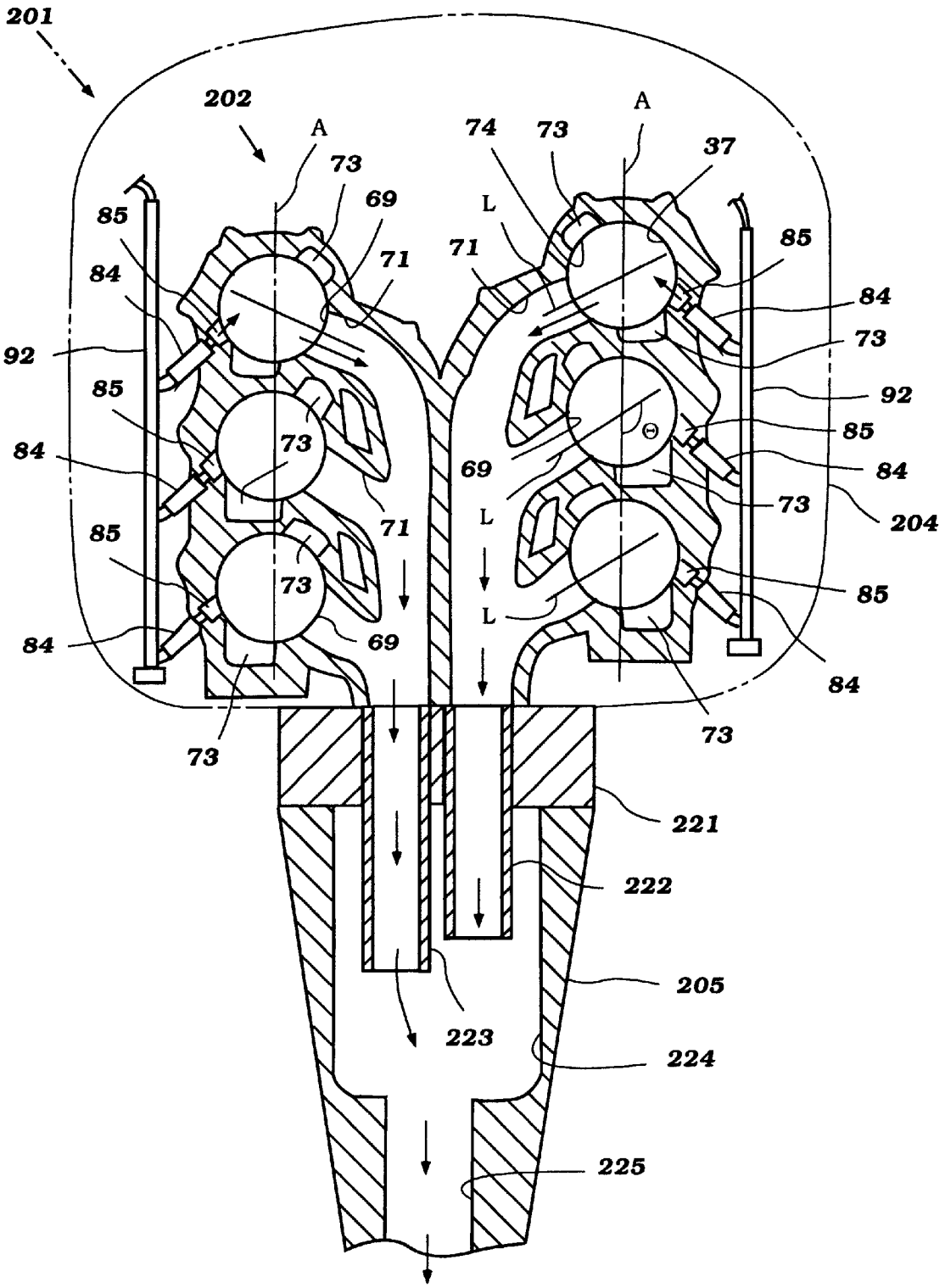
FIG. 27 is a view of an outboard motor, in part similar to FIG. 15, and shows another porting and scavenging arrangement.

FIG. 27 is a further embodiment which is like the embodiments of FIGS. 14–16 and FIG. 27 corresponds to FIG. 15. Again, however, the auxiliary main scavenge passage 77 and scavenge port 78 are deleted.

Thus, from the foregoing description, it should be readily apparent that the described embodiments of the invention provide a construction wherein fuel injection may be accomplished through or in proximity to an supplemental scavenge passage and yet the engine can be compact and the fuel injector mounted so that it can be easily accessed. Of course, the foregoing description is that of preferred embodiments of the invention and various changes and modifications may be made without departing from the spirit and scope of the invention, as defined by the appended claims.

I claim:

1. A two cycle internal combustion engine having a cylinder block defining at least two cylinder bores having parallel side by side axes lying in a common plane, a cylinder head closing one end of said cylinder bores, a piston reciprocating in each of said cylinder bores, an exhaust port formed in the said cylinder bores at the inlet end of a respective exhaust passage formed in said cylinder block and opened and closed by the reciprocation of the respective piston, said exhaust ports all lying on the same side of said common plane, a pair of circumferentially spaced main scavenge ports formed in each of said cylinder bores on opposite sides of said exhaust port and served by respective main scavenge passages configured so as to create a scavenging air flow that moves axially along the respective cylinder bore toward said cylinder head, across said respective cylinder bore and down said cylinder bore toward the respective exhaust port, and each of said cylinder bores having an supplemental scavenge port for introducing a air flow into the respective cylinder bore that flows into said respective cylinder bore and diametrically across said respective cylinder bore in a direction to redirect a portion of the flow from at least one of said main scavenge ports, said supplemental scavenge ports having their centers spaced around the circumference of the respective cylinder bore more than 90° from the center of the respective exhaust port, the centers of said exhaust ports all being displaced circumferentially from a perpendicular relation to said common plane in the same direction about the respective cylinder bore axis so that adjacent main scavenge passages of adjacent cylinder bores lie in side by side relation.

2. A two cycle internal combustion engine as set forth in claim 1, wherein the circumferential spacing of the ports for each cylinder bore are the same.

3. A two cycle internal combustion engine as set forth in claim 1, further including a plurality of fuel injectors, each injecting fuel for combustion in a respective cylinder bore.

4. A two cycle internal combustion engine as set forth in claim 3, wherein the fuel injectors inject fuel in the path of air flow from the respective supplemental scavenge passage.

5. A two cycle internal combustion engine as set forth in claim 4, wherein the fuel injectors inject fuel into the supplemental scavenge passage.

6. A two cycle internal combustion engine as set forth in claim 5, wherein the fuel injectors inject fuel in the direction of the respective supplemental scavenge port.

7. A two cycle internal combustion engine as set forth in claim 4, wherein the fuel injectors inject fuel directly into the respective cylinder bore.

8. A two cycle internal combustion engine as set forth in claim 7, wherein the fuel injectors inject fuel directly into the respective cylinder bore through the supplemental scavenge port.

9. A two cycle internal combustion engine as set forth in claim 7, wherein the fuel injectors inject fuel adjacent and above the supplemental scavenge port.

10. A two cycle internal combustion engine as set forth in claim 7, wherein the fuel injectors are mounted in the cylinder head.

11. A two cycle internal combustion engine as set forth in claim 1, wherein the flow from the supplemental scavenge ports creates a tumble motion in the respective cylinder bore.

12. A two cycle internal combustion engine as set forth in claim 1, further including a third main scavenge port between the pair of main scavenge ports and diametrically opposed to the exhaust port for each cylinder bore.

13. A two cycle internal combustion engine as set forth in claim 1, wherein the supplemental scavenge ports open before and close after the main scavenge ports.

14. A two cycle internal combustion engine as set forth in claim 1, wherein the upper edges of the supplemental scavenge ports have a greater circumferential extent than the lower edges.

15. A two cycle internal combustion engine as set forth in claim 1, wherein the upper edges of the main scavenge ports have a lesser circumferential extent than the lower edges.

16. A two cycle internal combustion engine as set forth in claim 15, wherein the upper edges of the supplemental scavenge ports has a greater circumferential extent than the lower edges.

17. A two cycle internal combustion engine as set forth in claim 16, wherein the supplemental scavenge ports open before and close after the main scavenge ports.

18. A two cycle internal combustion engine as set forth in claim 1, wherein the engine has two angularly disposed cylinder banks each having at least two cylinder bores, cylinder heads pistons and passages and ports as claimed therein.

19. A two cycle internal combustion engine as set forth in claim 18, wherein the cylinder banks define a valley therebetween and the exhaust passages in each cylinder bank is adjacent the valley.

20. A two cycle internal combustion engine as set forth in claim 1 wherein the ports are circumferentially positioned around the axes of the cylinder bores so that at least one of the scavenge passages serving one of said cylinder bores lies between one of the scavenge passages serving an adjacent cylinder bore and the exhaust passage serving that adjacent cylinder bore.

21. A two cycle internal combustion engine as set forth in claim 3 wherein the fuel injectors are mounted in and accessible from an outer surface of said engine.

22. A two cycle internal combustion engine as set forth in claim 21, wherein the fuel injectors inject fuel into the supplemental scavenge passage.

23. A two cycle internal combustion engine as set forth in claim 22, wherein the fuel injectors inject fuel in the direction of the respective supplemental scavenge port.

24. A two cycle internal combustion engine as set forth in claim 21, wherein the fuel injectors inject fuel directly into the respective cylinder bore.

25. A two cycle internal combustion engine as set forth in claim 24, wherein the fuel injectors inject fuel adjacent and above the supplemental scavenge port.

26. A two cycle internal combustion engine as set forth in claim 24, wherein the fuel injectors are mounted in the cylinder head.

27. A two cycle internal combustion engine as set forth in claim 24, wherein the fuel injectors inject fuel directly into the respective cylinder bore through the supplemental scavenge port.

* * * * *